US009981482B2

(12) United States Patent
Tanaka

(10) Patent No.: US 9,981,482 B2
(45) Date of Patent: May 29, 2018

(54) EXPOSURE HEAD, EXPOSURE UNIT, METHOD OF MANUFACTURING EXPOSURE UNIT, LIGHT RECEIVING HEAD, LIGHT RECEIVING UNIT, AND METHOD OF MANUFACTURING LIGHT RECEIVING UNIT

(71) Applicant: Oki Data Corporation, Minato-ku, Tokyo (JP)

(72) Inventor: Shintaro Tanaka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days. days.

(21) Appl. No.: 15/469,982

(22) Filed: Mar. 27, 2017

(65) Prior Publication Data

US 2017/0282593 A1 Oct. 5, 2017

(30) Foreign Application Priority Data

Mar. 31, 2016 (JP) ..... 2016-070978

(51) Int. Cl.
*B41J 27/00* (2006.01)
*B41J 2/45* (2006.01)
*B41J 2/447* (2006.01)

(52) U.S. Cl.
CPC ..... *B41J 2/451* (2013.01); *B41J 2/447* (2013.01); *B41J 2/45* (2013.01)

(58) Field of Classification Search
CPC ... B41J 2/45; B41J 2/451; B41J 2/447; G03G 15/01; G03G 15/5062; G03G 2215/0497; G03G 15/326; G03G 15/04054
USPC ..... 347/224, 225, 256, 257
See application file for complete search history.

(56) References Cited

U.S. PATENT DOCUMENTS 7,038,706 B1 5/2006 Hiyoshi
8,947,486 B2 * 2/2015 Tsuchiya ..... B41J 2/45 347/224
2009/0116970 A1 5/2009 Inoue et al.
2009/0185828 A1 * 7/2009 Koizumi ..... G02B 3/0056 399/218
2013/0176375 A1 * 7/2013 Moench ..... B41J 2/447 347/225

FOREIGN PATENT DOCUMENTS

JP 2002086791 A 3/2002
JP 2009113495 A 5/2009

* cited by examiner

*Primary Examiner* — An Do
(74) *Attorney, Agent, or Firm* — Panitch Schwarze Belisario & Nadel LLP

(57) ABSTRACT

An exposure unit includes first and second exposure heads. The first exposure head includes: first light emitting devices each emitting a first light beam; a first optical system performing imaging of each of the first light beams; a first coupler; and a first base member. The first coupler is provided at a first position, in the first base member, based on a position at which the imaging performed by the first optical system is performed. The second exposure head includes: second light emitting devices each emitting a second light beam; a second optical system performing imaging of each of the second light beams; a second coupler; and a second base member. The second coupler is provided at a second position, in the second base member, based on a position at which the imaging performed by the second optical system is performed and is fit into the first coupler.

14 Claims, 22 Drawing Sheets

(ADJUSTMENT IN X-AXIS DIRECTION)

(ADJUSTMENT IN Y-AXIS DIRECTION)

EXPOSURE HEAD, EXPOSURE UNIT, METHOD OF MANUFACTURING EXPOSURE UNIT, LIGHT RECEIVING HEAD, LIGHT RECEIVING UNIT, AND METHOD OF MANUFACTURING LIGHT RECEIVING UNIT

CROSS REFERENCE TO RELATED APPLICATIONS

The present application claims priority from Japanese Patent Application No. 2016-070978 filed on Mar. 31, 2016, the entire contents of which are hereby incorporated by reference.

BACKGROUND

The technology relates to an exposure head, an exposure unit, a method of manufacturing the exposure unit, a light receiving head, a light receiving unit, and a method of manufacturing the light receiving unit.

An exposure head including a lens array and a light-emitting device array that includes a plurality of light emitting devices such as light emitting diode (LED) devices is used in various image forming apparatuses. Non-limiting examples of such image forming apparatuses may include an electronic printer and a facsimile apparatus that each form an image by electrophotography scheme. For example, reference is made to Japanese Unexamined Patent Application Publication (JP-A) No. 2009-113495.

SUMMARY

An exposure unit included in an image forming apparatus according to JP-A No. 2009-113495 employs a configuration in which a plurality of exposure heads are joined together with each other at a joint and a focal position of each of the exposure heads is adjustable by an adjustment mechanism such as a spacer, an adjustment plate, and an adjustment screw.

However, upon manufacturing of an exposure unit provided with a plurality of exposure heads, it is necessary to adjust factors including a focal position of each of the exposure heads after joining together the exposure heads to each other. A series of such operations are complicated, therefore preventing a reduction in time necessary for manufacturing.

It is desirable to provide an exposure head, an exposure unit, a method of manufacturing an exposure unit, a light receiving head, a light receiving unit, and a method of manufacturing a light receiving unit that each achieve easier manufacturing.

According to one embodiment of the technology, there is provided an exposure unit that includes a first exposure head and a second exposure head. The first exposure head includes a plurality of first light emitting devices, a first optical system, a first coupler, and a first base member. The first light emitting devices are disposed side by side in a first direction and each emit a first light beam. The first optical system faces the first light emitting devices in a second direction that intersects with the first direction, and performs imaging of each of the first light beams emitted by the respective first light emitting devices. The first coupler is provided at a first position, in the first base member, based on a position at which the imaging performed by the first optical system is performed. The first base member supports the first light emitting devices, the first optical system, and the first coupler. The second exposure head includes a plurality of second light emitting devices, a second optical system, a second coupler, and a second base member. The second light emitting devices are disposed side by side in the first direction and each emit a second light beam. The second optical system faces the second light emitting devices in the second direction, and performs imaging of each of the second light beams emitted by the respective second light emitting devices. The second coupler is provided at a second position, in the second base member, based on a position at which the imaging performed by the second optical system is performed and being fit into the first coupler. The second base member supports the second light emitting devices, the second optical system, and the second coupler.

According to one embodiment of the technology, there is provided an exposure unit that includes a first exposure head and a second exposure head. The first exposure head includes a first substrate, a plurality of first light emitting devices, a first optical system, a first pedestal, a first coupler, and a first base member. The first light emitting devices are disposed side by side in a first direction on the first substrate and each emitting a first light beam. The first optical system faces the first light emitting devices in a second direction that intersects with the first direction, and performs imaging of each of the first light beams emitted by the respective first light emitting devices. The first pedestal is attached to the first substrate. The first coupler is provided at a first position, in the first pedestal, based on a position at which the imaging performed by the first optical system is performed. The first base member supports the first substrate and the first optical system. The second exposure head includes a second substrate, a plurality of second light emitting devices, a second optical system, a second pedestal, a second coupler, and a second base member. The second light emitting devices are disposed side by side in the first direction on the second substrate and each emit a second light beam. The second optical system faces the second light emitting devices in the second direction, and performs imaging of each of the second light beams emitted by the respective second light emitting devices. The second pedestal is attached to the second substrate. The second coupler is provided at a second position, in the second pedestal, based on a position at which the imaging performed by the second optical system is performed, and is fit into the first coupler. The second base member supports the second substrate and the second optical system.

According to one embodiment of the technology, there is provided an exposure unit that includes a first exposure head and a second exposure head. The first exposure head includes a first substrate, a plurality of first light emitting devices, a first optical system, and a first base member. The first substrate includes a first engagement part that is provided at a first position based on a position at which imaging performed by the first optical system is performed. The first light emitting devices are disposed side by side in a first direction on the first substrate and each emit a first light beam. The first optical system faces the first light emitting devices in a second direction that intersects with the first direction, and performs the imaging of each of the first light beams emitted by the respective first light emitting devices. The first base member supports the first substrate and the first optical system. The second exposure head includes a second substrate, a plurality of second light emitting devices, a second optical system, and a second base member. The second substrate includes a second engagement part that is provided at a second position based on a position at which imaging performed by the second optical system is performed, and is to be brought into engagement with the first engagement part. The second light emitting devices are disposed side by side in the first direction on the second substrate and each emit a second light beam. The second optical system faces the second light emitting devices in the second direction, and performs the imaging of each of the second light beams emitted by the respective second light emitting devices. The second base member supports the second substrate and the second optical system.

According to one embodiment of the technology, there is provided an image forming unit and an image forming apparatus that each include the foregoing exposure unit according to the embodiment of the technology.

According to one embodiment of the technology, there is provided an exposure head including a plurality of light emitting devices, an optical system, a coupler, and a base member. The plurality of light emitting devices are disposed side by side in a first direction and each emit a light beam. The optical system faces the light emitting devices in a second direction, and performs imaging of each of the light beams emitted by the respective light emitting devices. The second direction intersects with the first direction. The coupler is provided at a position, in a base member, based on a position at which the imaging performed by the optical system is performed. The base member supports the light emitting devices, the optical system, and the coupler.

According to one embodiment of the technology, there is provided a light receiving unit that includes a first light receiving head and a second light receiving head. The first light receiving head includes a plurality of first light receiving devices, a first optical system, a first coupler, and a first base member. The first light receiving devices are disposed side by side in a first direction. The first optical system faces the first light receiving devices in a second direction that intersects with the first direction, and performs imaging of, on the first light receiving devices, respective first light beams entering the first optical system from outside. The first coupler is provided at a first position, in the first base member, based on a position at which the imaging performed by the first optical system is performed. The first base member supports the first light receiving devices, the first optical system, and the first coupler. The second light receiving head includes a plurality of second light receiving devices, a second optical system, a second coupler, and a second base member. The second light receiving devices are disposed side by side in the first direction. The second optical system faces the second light receiving devices in the second direction, and performs imaging of, on the second light receiving devices, respective second light beams entering the second optical system from the outside. The second coupler is provided at a second position, in the second base member, based on a position at which the imaging performed by the second optical system is performed, and is fit into the first coupler. The second base member supports the second light receiving devices, the second optical system, and the second coupler.

According to one embodiment of the technology, there is provided an image reader that includes the foregoing light receiving unit according to the embodiment of the technology.

According to one embodiment of the technology, there is provided a method of manufacturing an exposure unit, the method including: preparing a first base member that supports a plurality of first light emitting devices and a first optical system, the first light emitting devices being disposed side by side in a first direction and each emitting a first light beam, the first optical system facing the first light emitting devices in a second direction that intersects with the first direction, and performing imaging of each of the first light beams emitted by the respective first light emitting devices; providing a first coupler at a first position, in the first base member, based on a position at which the imaging performed by the first optical system is performed; preparing a second base member that supports a plurality of second light emitting devices and a second optical system, the second light emitting devices being disposed side by side in the first direction and each emitting a second light beam, the second optical system facing the second light emitting devices in the second direction, and performing imaging of each of the second light beams emitted by the respective second light emitting devices; providing a second coupler at a second position, in the second base member, based on a position at which the imaging performed by the second optical system is performed; and joining together the first base member and the second base member with each other by fitting the first coupler and the second coupler into each other.

According to one embodiment of the technology, there is provided a method of manufacturing another exposure unit, the method including: preparing a first base member that supports a first substrate on which a plurality of first light emitting devices are provided and a first optical system, the first light emitting devices being disposed side by side in a first direction and each emitting a first light beam, the first optical system facing the first light emitting devices in a second direction that intersects with the first direction, and performing imaging of each of the first light beams emitted by the respective first light emitting devices; attaching a first pedestal to the first substrate; providing a first coupler at a first position, in the first pedestal, based on a position at which the imaging performed by the first optical system is performed; preparing a second base member that supports a second substrate on which a plurality of second light emitting devices are provided and a second optical system, the second light emitting devices being disposed side by side in the first direction and each emitting a second light beam, the second optical system facing the second light emitting devices in the second direction, and performing imaging of each of the second light beams emitted by the respective second light emitting devices; attaching a second pedestal to the second substrate; providing a second coupler at a second position, in the second pedestal, based on a position at which the imaging performed by the second optical system is performed; and joining together the first substrate and the second substrate with each other by fitting the first coupler and the second coupler into each other.

According to one embodiment of the technology, there is provided a method of manufacturing still another exposure unit, the method including: preparing a first base member that supports a first substrate on which a plurality of first light emitting devices are provided and a first optical system, the first light emitting devices being disposed side by side in a first direction and each emitting a first light beam, the first optical system facing the first light emitting devices in a second direction that intersects with the first direction, and performing imaging of each of the first light beams emitted by the respective first light emitting devices; processing part of the first substrate and thereby forming a first coupler at a first position, in the first substrate, based on a position at which the imaging performed by the first optical system is performed; preparing a second base member that supports a second substrate on which a plurality of second light emitting devices are provided and a second optical system, the second light emitting devices being disposed side by side in the first direction and each emitting a second light beam, the second optical system facing the second light emitting devices in the second direction, and performing imaging of each of the second light beams emitted by the respective second light emitting devices; processing part of the second substrate and thereby forming a second coupler at a second position, in the second substrate, based on a position at which the imaging performed by the second optical system is performed; and joining together the first substrate and the second substrate with each other by fitting the first coupler and the second coupler into each other.

According to one embodiment of the technology, there is provided a method of manufacturing a light receiving unit, the method including: preparing a first base member that supports a plurality of first light receiving devices and a first optical system, the first light receiving devices being disposed side by side in a first direction, the first optical system facing the first light receiving devices in a second direction that intersects with the first direction, and performing imaging of, on the first light receiving devices, respective first light beams entering the first optical system from outside; providing a first coupler at a first position, in the first base member, based on a position at which the imaging performed by the first optical system is performed; preparing a second base member that supports a plurality of second light receiving devices and a second optical system, the second light receiving devices being disposed side by side in the first direction, the second optical system facing the second light receiving devices in the second direction, and performing imaging of, on the second light receiving devices, respective second light beams entering the second optical system from the outside; providing a second coupler at a second position, in the second base member, based on a position at which the imaging performed by the second optical system is performed; and joining together the first base member and the second base member with each other by fitting the first coupler and the second coupler into each other.

According to one embodiment of the technology, there is provided a light receiving head corresponding to each of a plurality of light receiving heads that are joined together with each other and thereby configure a light receiving unit. The light receiving head includes a plurality of light receiving devices, an optical system, a coupler, and a base member. The plurality of light receiving devices are disposed side by side in a first direction. The optical system faces the light receiving devices in a second direction intersecting with the first direction, and performs imaging of, on the light receiving devices, respective light beams entering the optical system from outside. The coupler is provided at a position, in the base member, based on a position at which the imaging performed by the optical system is performed. The base member supports the light receiving devices, the optical system, and the coupler.

DETAILED DESCRIPTION

Some example embodiments of the technology are described below in detail with reference to the drawings. It is to be noted that the description below describes mere specific examples of the technology, and the technology is therefore not limited thereto. Further, the technology is not limited to factors such as arrangements, dimensions, and dimension ratios of components illustrated in the respective drawings. The description is given in the following order.

1. First Example Embodiment (Examples of an exposure unit, an image forming unit, and an image forming apparatus in each which holders are joined together with each other)

2. Second Example Embodiment (Examples of an exposure unit, an image forming unit, and an image forming apparatus in each which device substrates are joined together with each other)

3. Third Example Embodiment (An example in which a milling process is performed on part of the device substrate)

4. Fourth Example Embodiment (An example of an image reader with a light receiving unit)

5. Other Modification Examples

1. First Example Embodiment

[Outline Configuration of Exposure Unit 10]

Figure 1:
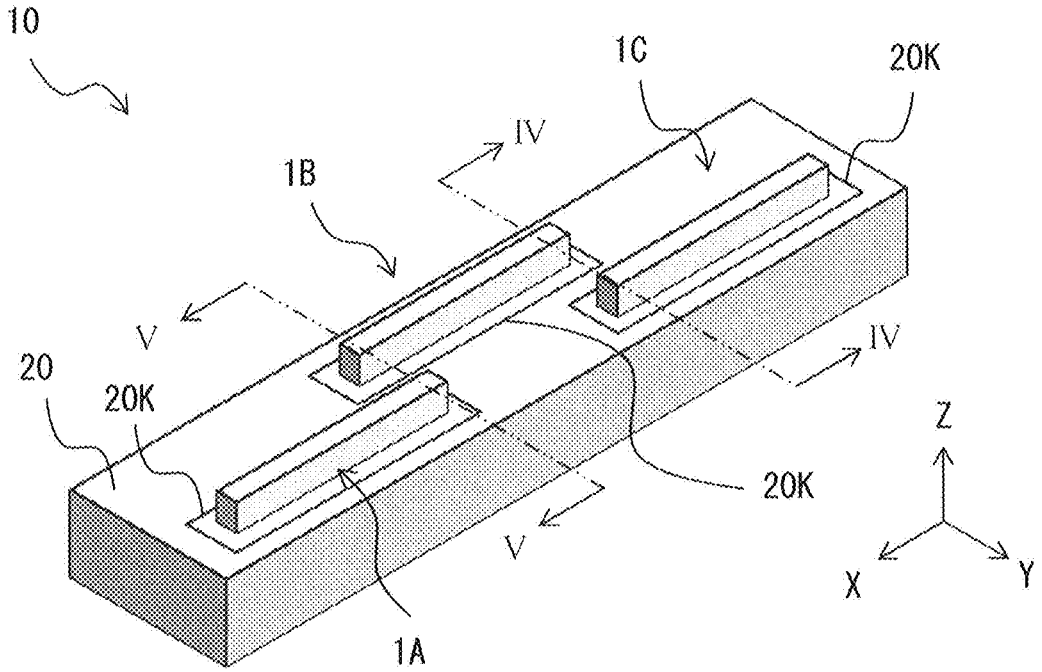
FIG. 1 is a perspective view of an example of an overall configuration of an exposure unit according to a first example embodiment of the technology.
Figure 2:
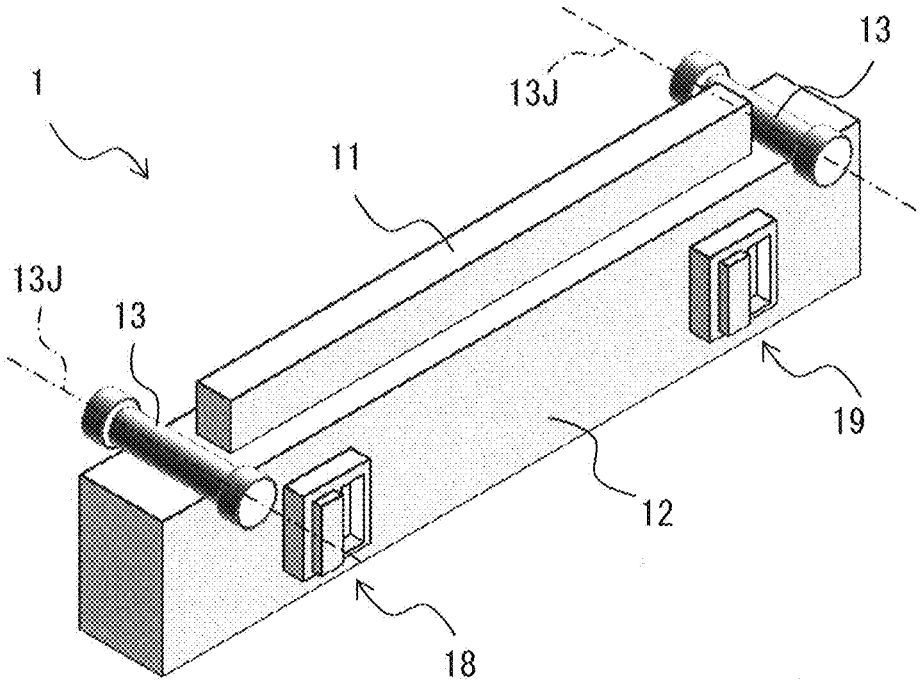
FIG. 2 is a perspective view of an exposure head illustrated in FIG. 1.
Figure 3:
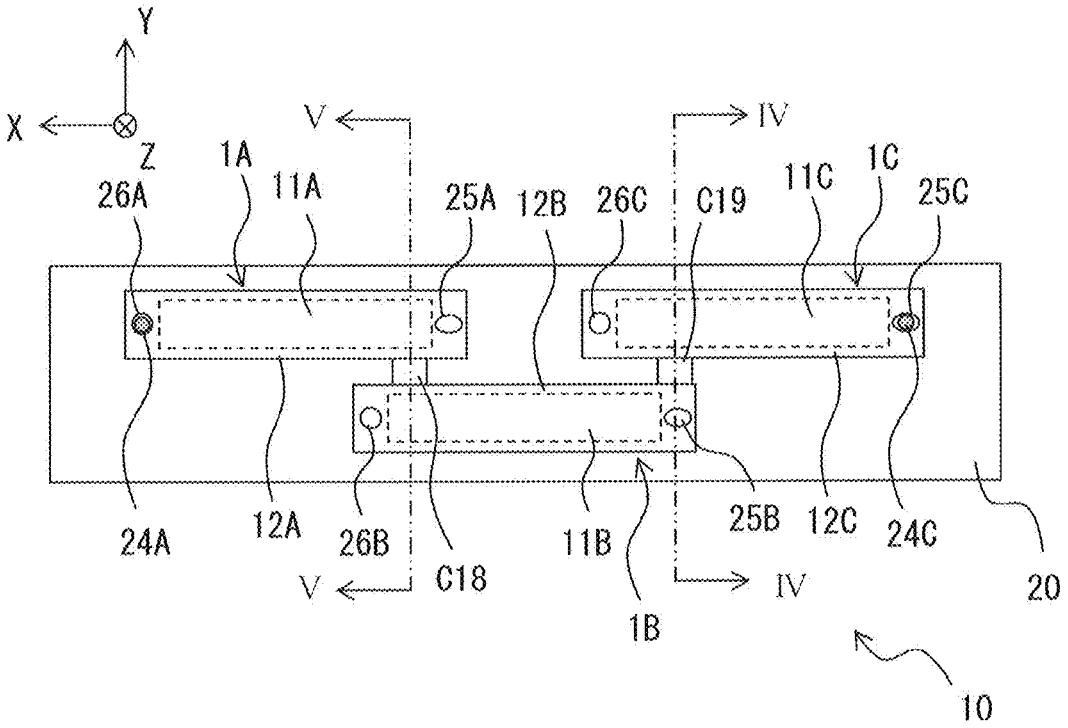
FIG. 3 is a plan view of an example of the overall configuration of the exposure unit illustrated in FIG. 1.
Figure 4:
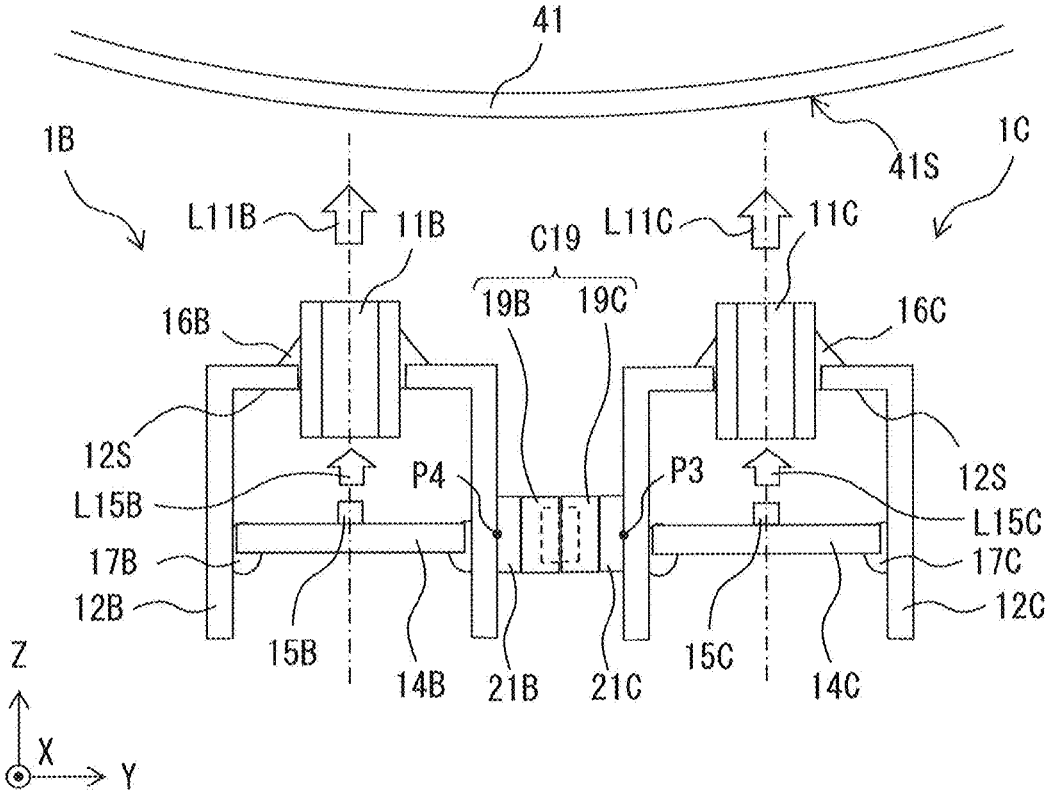
FIG. 4 is a cross-sectional view of the exposure unit illustrated in FIG. 1.
Figure 5:
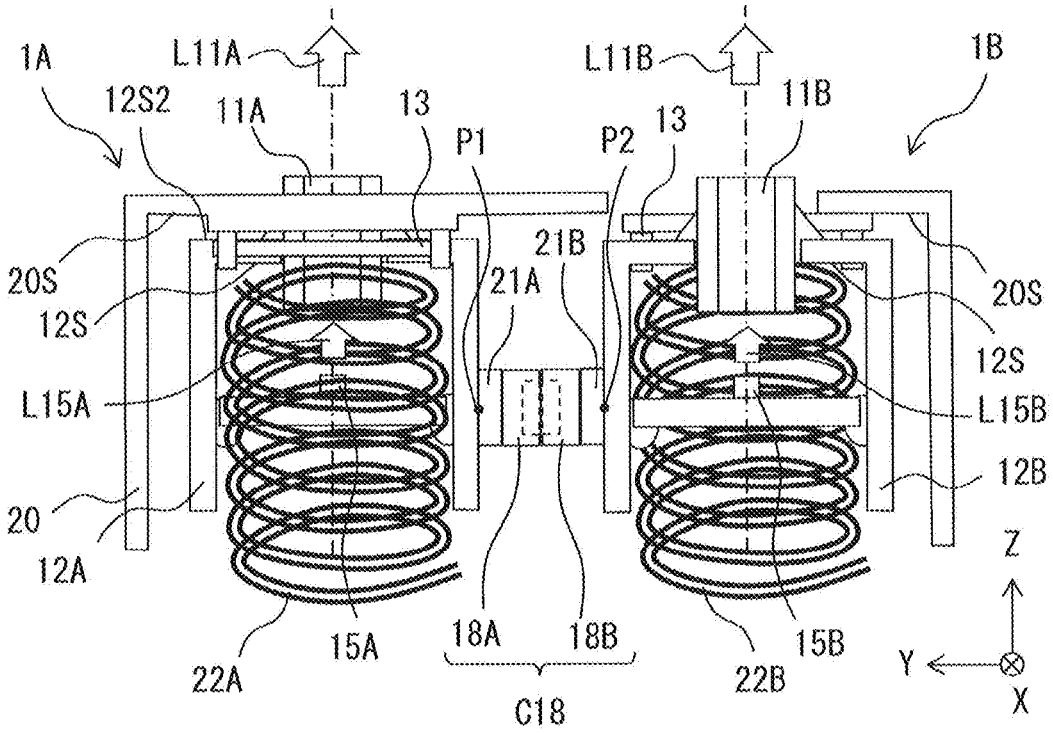
FIG. 5 is another cross-sectional view of the exposure unit illustrated in FIG. 1.

FIG. 1 is a perspective view of an example of an overall configuration of an exposure unit 10 according to a first example embodiment of the technology. FIG. 2 is a perspective view of an exposure head 1 (any of exposure heads 1A to 1C) illustrated in FIG. 1. FIG. 3 is a plan view of an example of an overall configuration of the exposure unit 10 viewed from below of the exposure unit 10 in a +Z direction. FIG. 4 is a cross-sectional view of the exposure unit 10 taken along a line IV-IV of any of FIGS. 1 and 3 in a direction indicated by arrows attached to the line IV-IV. FIG. 5 is a cross-sectional view of the exposure unit 10 taken along a line V-V of any of FIGS. 1 and 3 in a direction indicated by arrows attached to the line V-V. The exposure unit 10 may correspond to an "exposure unit" according to one specific but non-limiting embodiment of the technology. The exposure head 1 may correspond to an "exposure head" according to one specific but non-limiting embodiment of the technology. Each of the exposure unit 10 and the exposure head 1 may extend having a longitudinal direction in an X-axis direction. The X-axis direction may correspond to a "first direction" according to one specific but non-limiting embodiment of the technology.

The exposure unit 10 may include a plurality of exposure heads 1 in a single base holder 20. The first example embodiment is described referring to an example case in which three exposure heads 1A, 1B, and 1C are provided in the single base holder 20. However, the technology is not limited to this configuration. Specifically, the exposure unit 10 may include only two exposure heads 1, or may include four or more exposure heads 1. The base holder 20 may have three openings 20K. Most part of each of the exposure heads 1A to 1C may be included in the base holder 20. Each of the exposure heads 1A to 1C may be held by the base holder 20 while a lens array 11 (11A, 11B, or 11C) is exposed to outside of the base holder 20 from the corresponding opening 20K. The lens array 11 (11A, 11B, or 11C) may be part of the exposure head 1 (corresponding one of the exposure heads 1A to 1C). Specifically, referring to FIG. 3 as one example, long holes 25A to 25C and reference holes 26A to 26C may be provided on top of holders 12A to 12C, respectively, for example. Reference pins 24A and 24C may stand inside the base holder 20. The reference pin 24A may be inserted into the reference hole 26A of the holder 12A and the reference pin 24C may be inserted into the long hole 25C of the holder 12C. The holders 12A to 12C may be thereby aligned with the base holder 20 in an X-Y plane. It is to be noted that the reference pin 24C may be movable in a range corresponding to a dimension of the long hole 25C in the X-axis direction. This makes it possible for the exposure heads 1A to 1C to respectively address expansion and contraction of the holders 12A to 12C. The holders 12A to 12C may each be pressed against the base holder 20 in a Z-axis direction by a biasing member 22 which will be described later.

Each of the exposure heads 1A to 1C may be a so-called light emitting diode (LED) head, for example. The exposure heads 1A to 1C may have configurations that are substantially the same as each other, for example. Specifically, the exposure head 1A may include the holder 12A. The exposure head 1A may further include a plurality of light emitting devices 15A, a lens array 11A, a pair of engagement parts 18A and 19A that are provided on the holder 12A. Similarly, the exposure head 1B may include the holder 12B. The exposure head 1B may further include a plurality of light emitting devices 15B, a lens array 11B, a pair of engagement parts 18B and 19B that are provided on the holder 12B. Similarly, the exposure head 1C may include the holder 12C. The exposure head 1C may further include a plurality of light emitting devices 15C, a lens array 11C, a pair of engagement parts 18C and 19C that are provided on the holder 12C. The holders 12A to 12C may be collectively referred to as the holder 12. The light emitting devices 15A to 15C may be collectively referred to as light emitting devices 15. The lens arrays 11A to 11C may be collectively referred to as the lens array 11. The engagement parts 18A to 18C may be collectively referred to as an engagement part 18. The engagement parts 19A to 19C may be collectively referred to as an engagement part 19. The holders 12A to 12C may each include a material such as sheet metal, polycarbonate, acrylonitrile butadiene styrene (ABS) resin, liquid crystal polymer, and die-cast aluminum. The holders 12A to 12C may preferably have shapes and dimensions that are substantially the same as each other. The light emitting devices 15A may be LED devices that each emit a light beam L15A as illustrated in FIG. 5. The light emitting devices 15A may be disposed, on a single device substrate 14A, side by side in a row in the X-axis direction. The light emitting devices 15B may be LED devices that each emit a light beam L15B as illustrated in FIGS. 4 and 5. The light emitting devices 15B may be disposed, on a single device substrate 14B, side by side in a row in the X-axis direction. The light emitting devices 15C may be LED devices that each emit a light beam L15C as illustrated in FIG. 4. The light emitting devices 15C may be disposed, on a single device substrate 14C, side by side in a row in the X-axis direction. The device substrates 14A to 14C may be collectively referred to as a device substrate 14. A member including the device substrate 14 and the light emitting devices 15 disposed on the device substrate 14 may be referred to as a light-emitting device array LU.

The lens arrays 11A to 11C may be respectively fixed to the holders 12A to 12C by adhesive agents 16A to 16C, while being respectively inserted into openings (slits) provided on the top of the holders 12A to 12C, for example. Gaps between the lens arrays 11A to 11C and the corresponding holders 12A to 12C may be sealed respectively by adhesive agents 16A to 16C as illustrated in FIGS. 4 and 5. This prevents entering of a foreign substance such as a toner into internal space of each of the holders 12A to 12C. The internal space of the holders 12A to 12C may correspond to space in which the light emitting devices 15A to 15C are respectively provided. The device substrates 14A to 14C may each be a glass epoxy substrate, for example. The device substrates 14A to 14C may be fixed to lower parts of the holders 12A to 12C with adhesive agents 17A to 17C, respectively, for example. Gaps between the device substrates 14A to 14C and the corresponding holders 12A to 12C may be sealed respectively by adhesive agents 17A to 17C. This prevents entering of a foreign substance such as a toner into the internal space of each of the holders 12A to 12C. Referring to FIG. 2, the engagement part 18 (any of 18A to 18C) and the engagement part 19 (corresponding one of 19A to 19C) may be fixed to the respective vicinities of both ends, in the X-axis direction, of a side surface of the holder 12 (corresponding one of 12A to 12C). The engagement parts 18A to 18C and the engagement parts 19A to 19C may be fixed to the side surfaces of the holders 12A to 12C, for example, with adhesive agents 21A to 21C, respectively. However, a method of performing the fixing is not limited to adhesion. The foregoing fixing may be performed by another method such as welding, fusing, and screwing. The engagement part 18A may be inserted into the engagement part 18B in a Y-axis direction and thereby brought into engagement with the engagement part 18A. This may provide a joint C18 as illustrated in FIGS. 3 and 5. The engagement part 19B may be inserted into the engagement part 19C in the Y-axis direction and thereby brought into engagement with the engagement part 19C. This may provide a joint C19 as illustrated in FIGS. 3 and 4. The three exposure heads 1A to 1C may be integrated together with each other and thereby provide a single long exposure unit 10.

The engagement part 18A may be provided at a position P1, in the holder 12A, that is based on a position at which imaging performed by the lens array 11A is performed. The position at which the imaging performed by the lens array 11A is performed may be referred to as an "imaging position of the lens array 11A". This is also applicable to other lens arrays. The engagement part 18B may be provided at a position P2, in the holder 12B, that is based on an imaging position of the lens array 11B. Similarly, the engagement part 19C may be provided at a position P3, in the holder 12C, that is based on an imaging position of the lens array 11C. The engagement part 19B may be provided at a position P4, in the holder 12B, that is based on an imaging position of the lens array 11B. It is to be noted that the "imaging position" referred to above may be determined for the respective lens arrays 11A to 11C and may be defined in at least one of the X-axis direction, the Y-axis direction, and the Z-axis direction, for example. To give a specific but non-limiting example, the position P1 may be determined, in the Z-axis direction, on the basis of an average focal length of the lens array 11A. The engagement parts 18A and 18B and the engagement parts 19C and 19B may be provided respectively at the positions P1 to P4 that are based on the imaging positions of the corresponding lens arrays 11A to 11C as described above. The positions P1 to P4 in the side surfaces of the holders 12A to 12C may be relatively different from each other.

The light emitting devices 15A, 15B, and 15C may respectively correspond to "first light emitting devices", "second light emitting devices", and "third light emitting devices" according to one specific but non-limiting embodiment of the technology. The lens arrays 11A, 11B, and 11C may respectively correspond to a "first optical system", a "second optical system", and a "third optical system" according to one specific but non-limiting embodiment of the technology. The holders 12A, 12B, and 12C may respectively correspond to a "first base member", a "second base member", and a "third base member" according to one specific but non-limiting embodiment of the technology. The engagement part 18A may correspond to a "first coupler" according to one specific but non-limiting embodiment of the technology. The engagement part 18B may correspond to a "second coupler" according to one specific but non-limiting embodiment of the technology. The engagement part 19C may correspond to a "third coupler" according to one specific but non-limiting embodiment of the technology. The engagement part 19B may correspond to a "fourth coupler" according to one specific but non-limiting embodiment of the technology.

Figure 6:
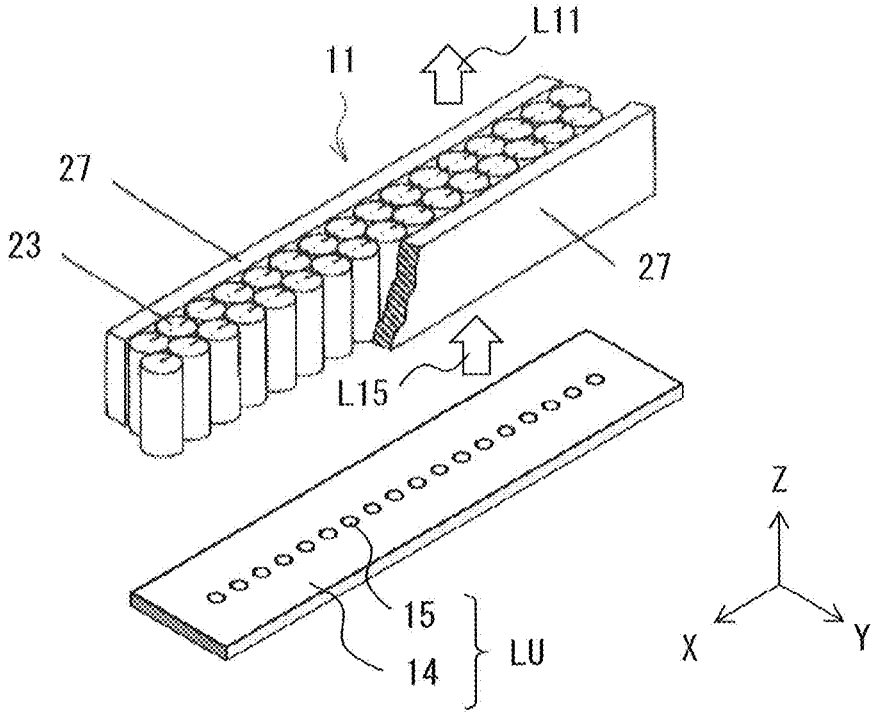
FIG. 6 is a perspective partial cutaway view of enlarged part of a lens array illustrated in FIG. 1.

FIG. 6 is a perspective partial cutaway view of enlarged part of the lens array 11. Referring to FIG. 6, the lens array 11 may include a plurality of rod lenses 23 and a pair of side plates 27. The rod lenses 23 may be disposed side by side in two rows in the X-axis direction. The pair of side plates 17 may so face each other as to sandwich, in the Y-axis direction, the rod lenses 23 in between. The Y-axis direction is orthogonal to both the X-axis direction and the Z-axis direction. The Y-axis direction may correspond to a "third direction" according to one specific but non-limiting embodiment of the technology. The respective rod lenses 23 may have substantially-cylindrical outer shapes that are substantially the same as each other in dimensions, for example. A gap between the rod lenses 23 and a gap between the rod lenses 23 and the side plates 27 may be filled with an adhesive agent.

The exposure head 1 may include a biasing member 22 such as a coil spring. The biasing member 22 may have one end that is fixed to a lower part of the base holder 20 and the other end that is so provided in contact with a back surface 12S of the top of the holder 12 as to bias the back surface 12S. The exposure head 1 may be pressed, by biasing force of the biasing member 22, against a back surface 20S of the top of the base holder 20. The exposure head 1 may further include a pair of adjusting members 13 in the vicinities of both ends of the top of the holder 12, for example, as illustrated in FIGS. 2 and 5. The adjusting members 13 may be a mechanism that adjusts a distance from the lens array 11 to an object to which the light beams from the light-emitting device array LU are applied. The object to which the light beams from the light-emitting device array LU are applied may be a surface 41S of a photosensitive drum 41 illustrated in FIG. 4, for example. The adjusting members 13 may each include an eccentric cam, for example. Specifically, each of the adjusting members 13 may rotate around an axis 13J illustrated in FIG. 2. This may cause the exposure head 1 to move upward or downward, i.e., shift in the Z-axis direction, with respect to the base holder 20 on the basis of a direction of the rotation of the adjusting members 13.

Figure 7A:
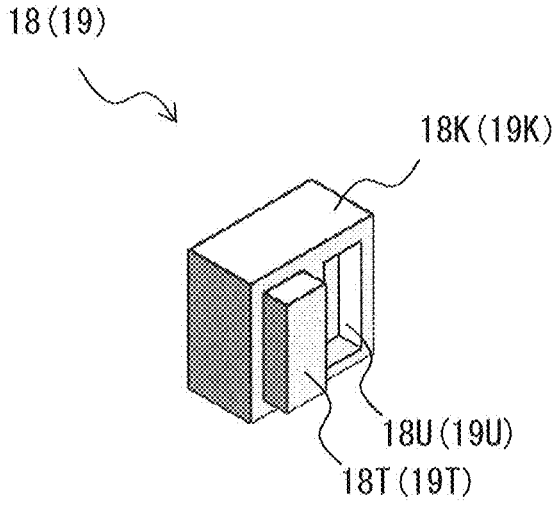
FIG. 7A is a perspective view of a configuration example of an engagement part illustrated in FIG. 2.
Figure 7B:
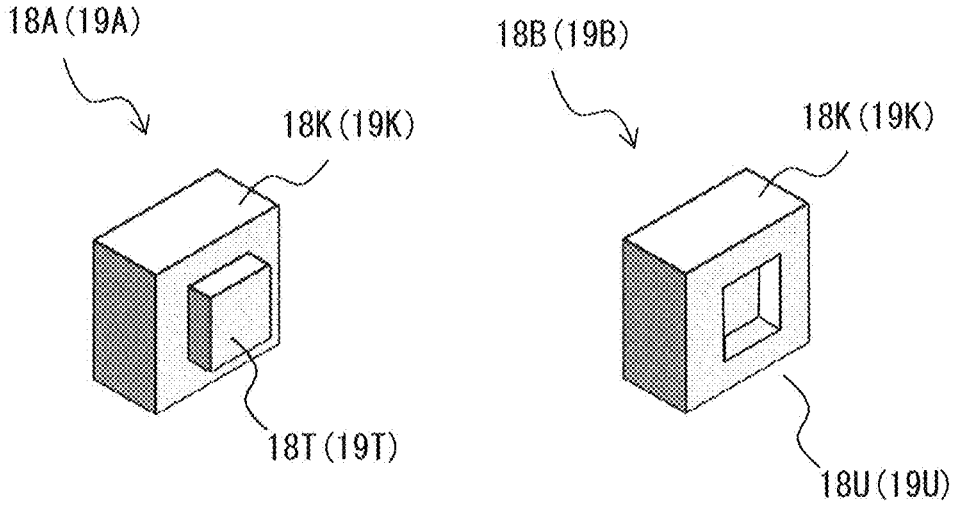
FIG. 7B is a perspective view of another configuration example of the engagement part illustrated in FIG. 2.

FIG. 7A is a perspective view of an example configuration of the engagement part 18 (or 19). Referring to FIG. 7A, the engagement part 18 (or 19) may include a base 18K (or 19K) as well as a convex 18T (or 19T) and a concave 18U (or 19U) that are provided on a surface of the base 18K (or 19K), for example. This configuration may allow the convex 18T of one of the pair of the engagement part 18A and the engagement part 18B that face each other to be fit into the concave 18U of the other of the pair of the engagement part 18A and the engagement part 18B, for example. It is to be noted that, as illustrated in FIG. 7B, the convex 18T (or 19T) may be provided on one engagement part 18A (or 19A) and the concave 18U (or 19U) may be provided on another engagement part 18B (or 19B), for example.

The exposure unit 10 may be mounted on an image forming apparatus which will be described later, for example. Non-limiting example of the image forming apparatus may include an electronic printer. In this case, the exposure unit 10 may be so disposed as to face an object to which the light beams are applied as illustrated in FIG. 4, for example. The object to which the light beams are applied may be the photosensitive drum 41, for example.

[Method of Manufacturing Exposure Unit 10]

Figure 8:
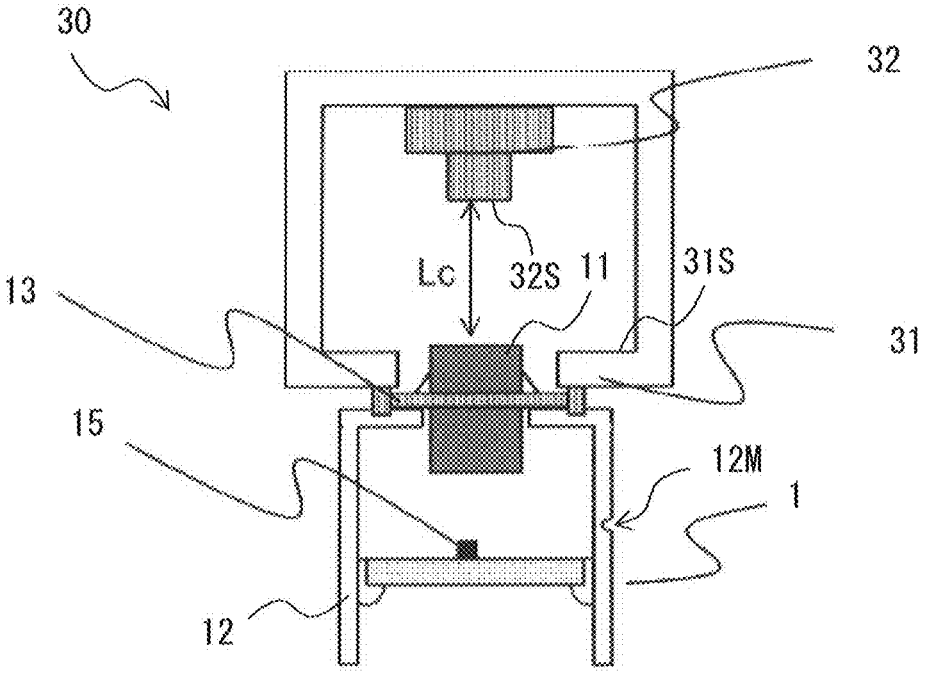
FIG. 8 schematically illustrates an optical image measuring apparatus that is to be used in a process of manufacturing the exposure unit illustrated in FIG. 1.
Figure 9A:
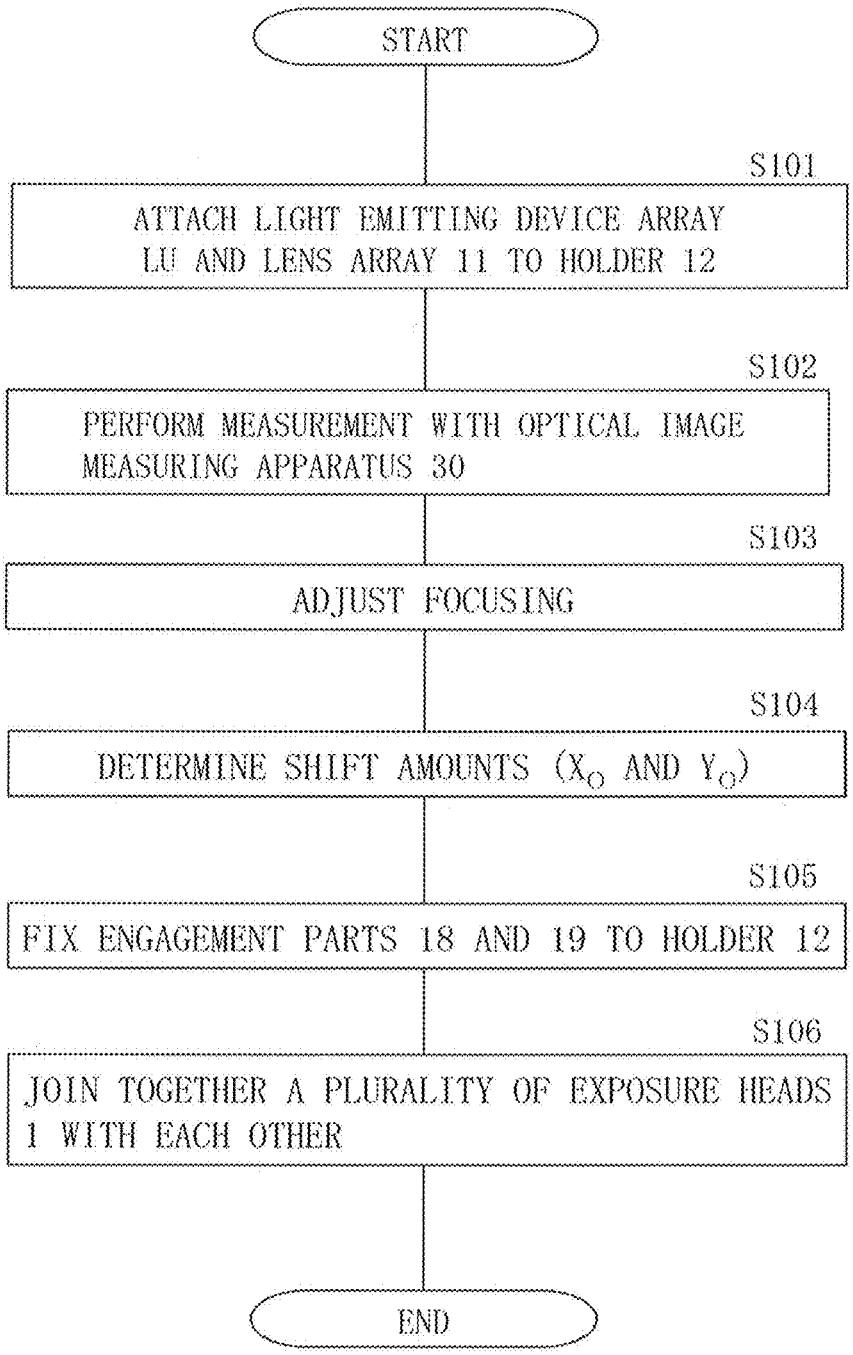
FIG. 9A is a flow chart of manufacturing of the exposure unit illustrated in FIG. 1.
Figure 9B:
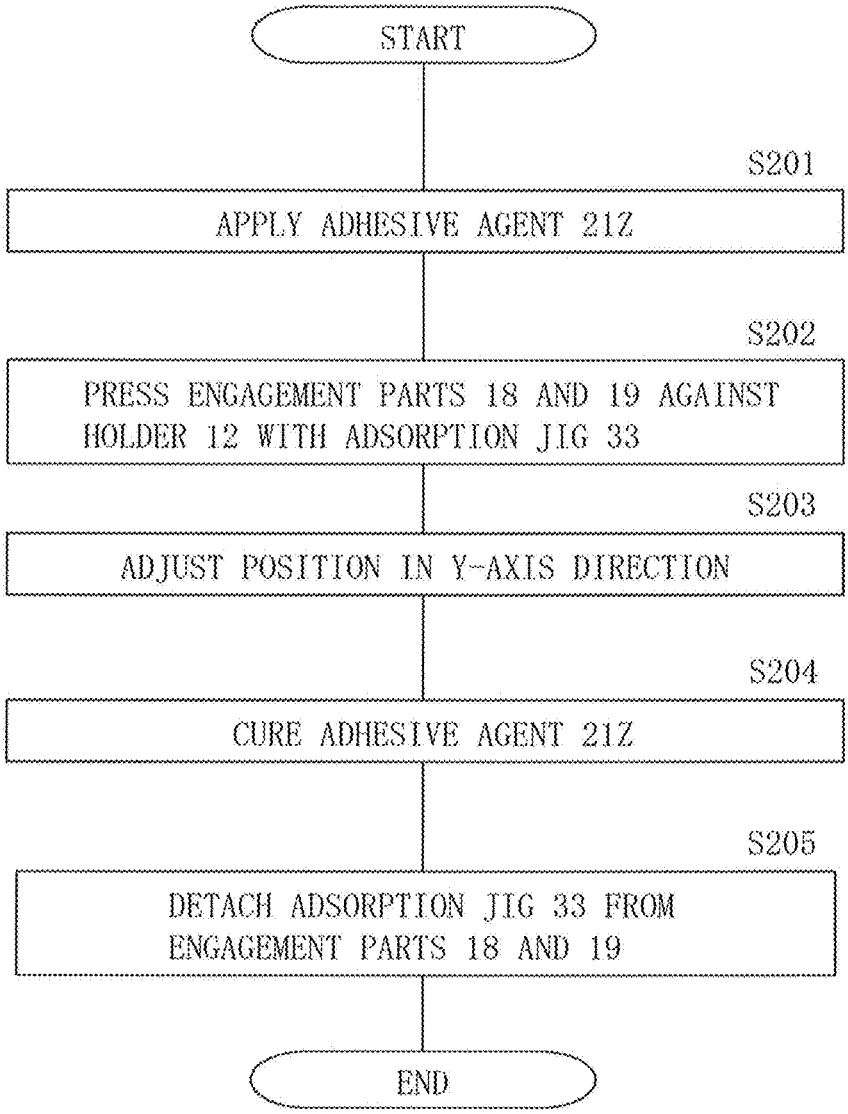
FIG. 9B is another flow chart of the manufacturing of the exposure unit illustrated in FIG. 1.

An example of a method of manufacturing the exposure unit 10 is described below. An optical image measuring apparatus 30 illustrated in FIG. 8 may be used upon the manufacturing of the exposure unit 10, for example. The optical image measuring apparatus 30 may include a housing 31 and an optical sensor 32. The housing may include a reference surface 31S. The optical sensor 32 may be disposed inside the housing 31. A distance Lc from the reference surface 31S to a light receiving surface 32S of the optical sensor 32 may be fixed. The method of manufacturing the exposure unit 10 is described below with reference to flow charts illustrated in FIGS. 9A and 9B.

First, the light-emitting device array LU and the lens array 11 may be attached to the holder 12 (step S101). Specifically, the holder 12, the light-emitting device array LU, and the lens array 11 may be prepared. Thereafter, the lens array 11 may be inserted into the slit provided in the upper part of the holder 12. The inserted lens array 11 may be fixed to the holder 12 with the adhesive agent 16. Further, the light-emitting device array LU may be so fixed to the lower part of the holder 12 with the adhesive agent 16 that the light emitting devices 15 face a light entering end surface of the lens array 11. Thereafter, the adjusting members 13 may be attached to the holder 12 and the biasing member 22 may be attached to the base holder 20. Marks 12M may be provided at positions on the side surfaces of the respective holders 12 as illustrated in diagrams such as that in FIG. 12A which will be described later. The marks 12M may each serve as a reference upon the attachment of the engagement parts 18 and 19. The marks 12M may each be a concave that is formed by a protruding process, for example.

Figure 10A:
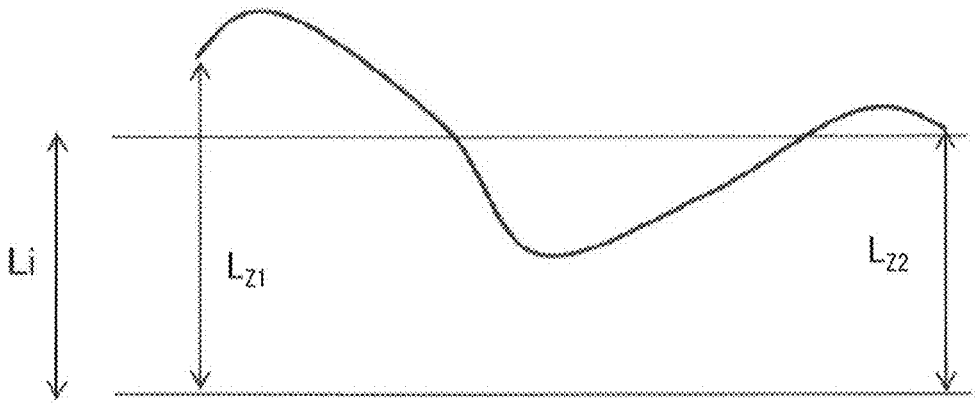
FIG. 10A schematically illustrates an example of a focal length distribution before adjustment of focusing of the exposure unit illustrated in FIG. 1.
Figure 10B:
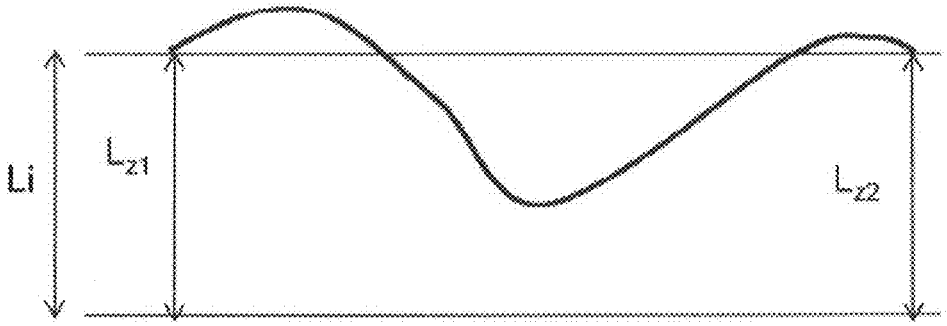
FIG. 10B schematically illustrates an example of the focal length distribution after the adjustment of the focusing of the exposure unit illustrated in FIG. 1.

Thereafter, the imaging position of each of the light beams L11 that derive from the respective light emitting devices 15 and pass through the lens array 11 may be measured with the optical image measuring apparatus 30 (step S102). The imaging position to be measured may include a position in the X-axis direction, a position in the Y-axis direction, and a position in the Z-axis direction. Thereafter, the focal position, the imaging position in the Z-axis direction may be adjusted on the basis of a result of the measurement (step S103). Specifically, referring to a graph illustrated in FIG. 10A, the light beams L11 that derive from the respective light emitting devices 15 and pass through the lens array 11 may have focal positions that are different from each other. In step S103, focusing adjustment may be performed by so causing the holder 12 to move upward or downward by the adjusting members 13 that focal lengths $L_{z1}$ and $L_{z2}$ to be coincident with the focal length Li as illustrated in FIG. 10B, for example. The focal lengths $L_{z1}$ and $L_{z2}$ may be focal lengths of the light beams L11 at both ends in the X-axis direction as illustrated in FIG. 10B, for example. The focal length Li may be a distance from the exposure unit 10 to the object such as the photosensitive drum 41 to which the light beams emitted from the exposure unit 10 mounted on the image forming apparatus are applied. The focal length Li may be equal to the distance Lc from the reference surface 31S to the light receiving surface 32S in the optical image measuring apparatus 30. The focal length Li may be so adjusted that a modulation transfer function (MTF) is at the maximum on the photosensitive drum 41, for example. A horizontal axis of each of FIGS. 10A and 10B represents the position of the exposure head 1 in the X-axis direction and a vertical axis of each of FIGS. 10A and 10B represents the focal length.

Figure 11A:
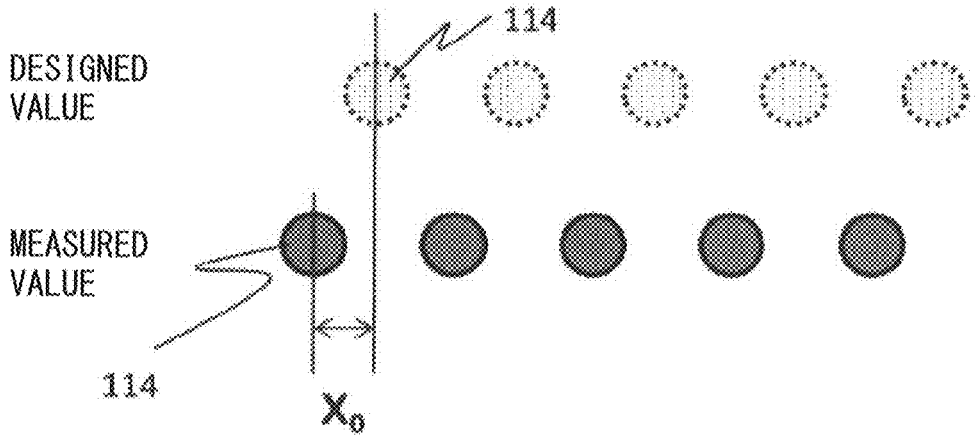
FIG. 11A schematically illustrates a difference between a designed value and a measured value of an imaging position of the lens array in the exposure unit illustrated in FIG. 1.
Figure 11B:
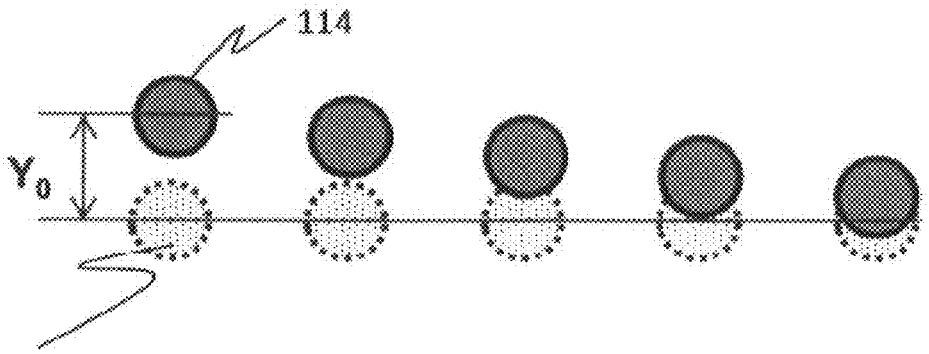
FIG. 11B also schematically illustrates the difference between the designed value and the measured value of the imaging position of the lens array in the exposure unit illustrated in FIG. 1.

Referring to FIGS. 11A and 11B, after the focusing adjustment, a difference (shift amounts $X_O$ and $Y_O$) between a designed value and a measured value may be determined for each of spots 114 of the light beams L11 that derive from the respective light emitting devices 15 and pass through the lens array 11 (step S104).

Figure 12A:
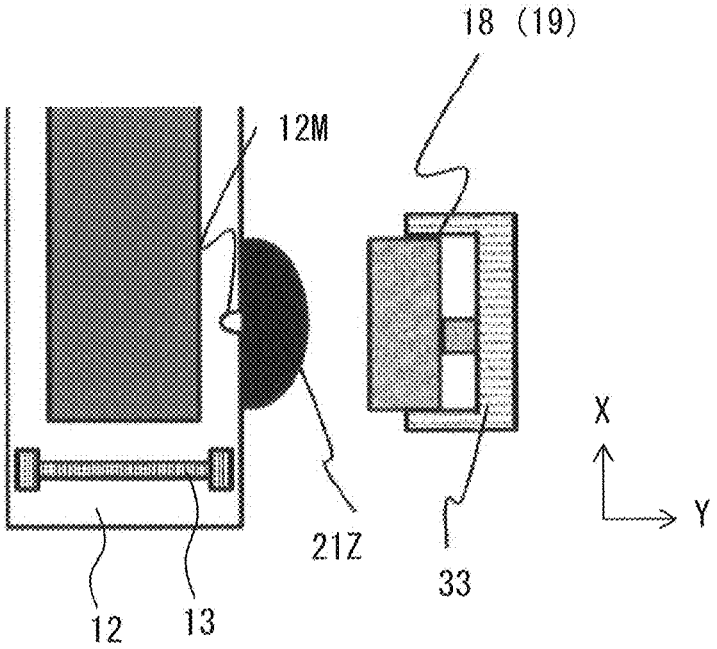
FIG. 12A schematically illustrates a process to be performed upon fixing of the engagement part to a base member in the exposure head illustrated in FIG. 1.

Thereafter, the engagement parts 18 and 19 may be fixed to the holder 12 (step S105). Specifically, an operation may be performed on the basis of the flow illustrated in FIG. 9B. Referring to FIG. 12A, first, an adhesive agent 21Z may be applied, with a dispenser, onto the side surface of the holder 12 around a position that is shifted from the mark 12M in the X-axis direction by the shift amount $X_O$ (step S201). The adhesive agent 21Z may refer to an adhesive agent before being cured. The adhesive agent 21Z may be cured and thereby become the adhesive 21 (corresponding one of 21A to 21C).

Figure 12B:
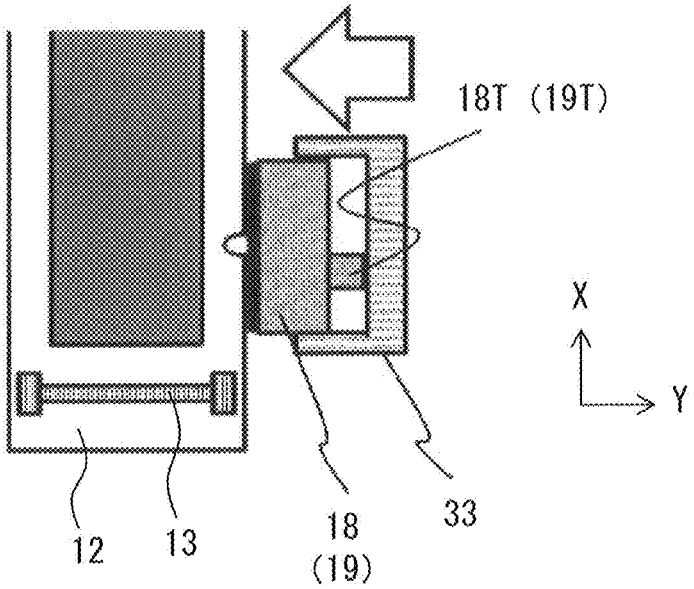
FIG. 12B schematically illustrates a process following the process illustrated in FIG. 12A.
Figure 12C:
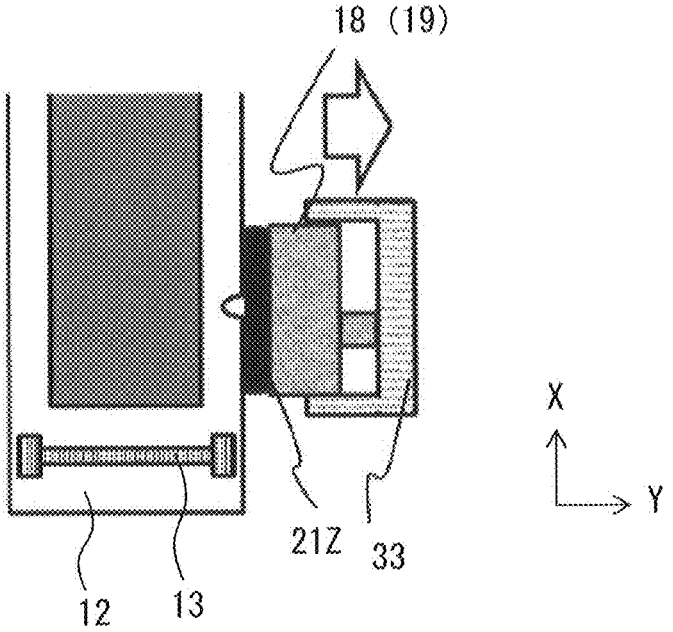
FIG. 12C schematically illustrates a process following the process illustrated in FIG. 12B.
Figure 12D:
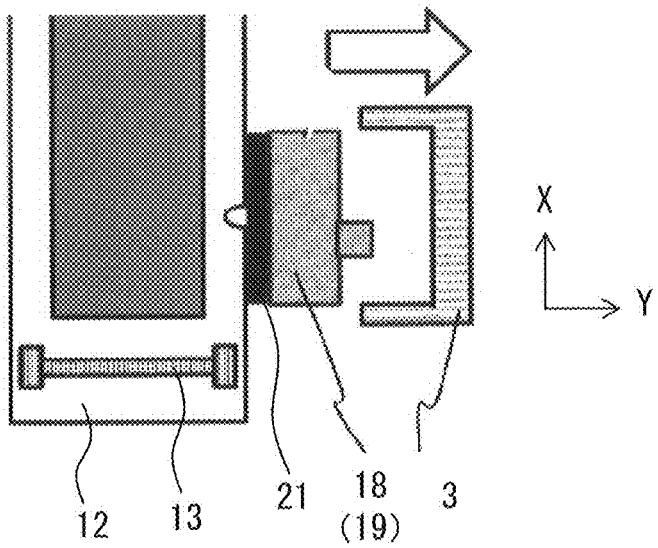
FIG. 12D schematically illustrates a process following the process illustrated in FIG. 12C.

Thereafter, the engagement part 18 (or 19) adsorbed onto an adsorption jig 33 may be brought closer to the adhesive agent 21Z applied onto the holder 12, and the engagement part 18 (or 19) may be pressed against the holder 12 in a −Y direction, thereby crushing the adhesive agent 21Z as illustrated in FIG. 12B (step S202). Thereafter, referring to FIG. 12C, the position of the engagement part 18 (or 19) in the Y-axis direction may be adjusted by pulling back the adsorption jig 33 in the +Y direction, thereby holding the engagement part 18 (or 19) at the position in the Y-axis direction in accordance with the shift amount $Y_O$ measured in step S104 (step S203). This state may be maintained until the adhesive agent 21Z is cured (step S204). After the adhesive agent 21Z is cured, the engagement part 18 (or 19) may be released from the adsorption onto the adsorption jig 33. The adsorption jig 33 may be thereby detached from the engagement part 18 (or 19) as illustrated in FIG. 12D (step S205).

This may complete the exposure head 1. Lastly, the plurality of exposure heads 1 each fabricated in the foregoing manner may be joined together with each other and thereby integrated together with each other. Upon the joining and the integrating of the exposure heads 1, the engagement parts 18 fixed to the respective holders 12 may be joined together with each other and thereby form the joint C18. The engagement parts 19 fixed to the respective holders 12 may be also joined together with each other and thereby form the joint C19. Thereafter, the exposure heads 1 integrated together with each other may be attached to the base holder 20, which may complete the exposure unit 10 (step S106).

[Modification Example of Method of Manufacturing Exposure Unit 10]

The foregoing manufacturing method refers to an example in which the engagement part is made in advance of a material such as resin and fixing of such an engagement part is performed through adhesion with the adhesion agent. However, the engagement part 18 (or 19) may be formed at a predetermined position using ultra-violet (UV) curable resin in the following manner according to the present example embodiment.

Figure 13A:
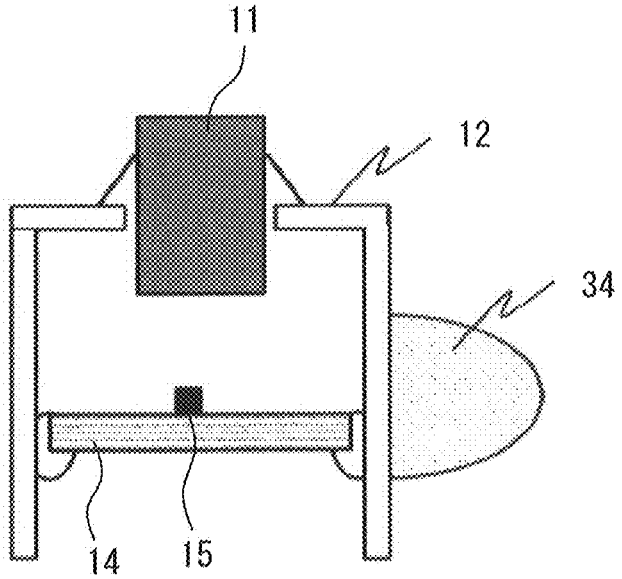
FIG. 13A schematically illustrates a process in a modification example of a method of manufacturing the exposure unit illustrated in FIG. 1.
Figure 13B:
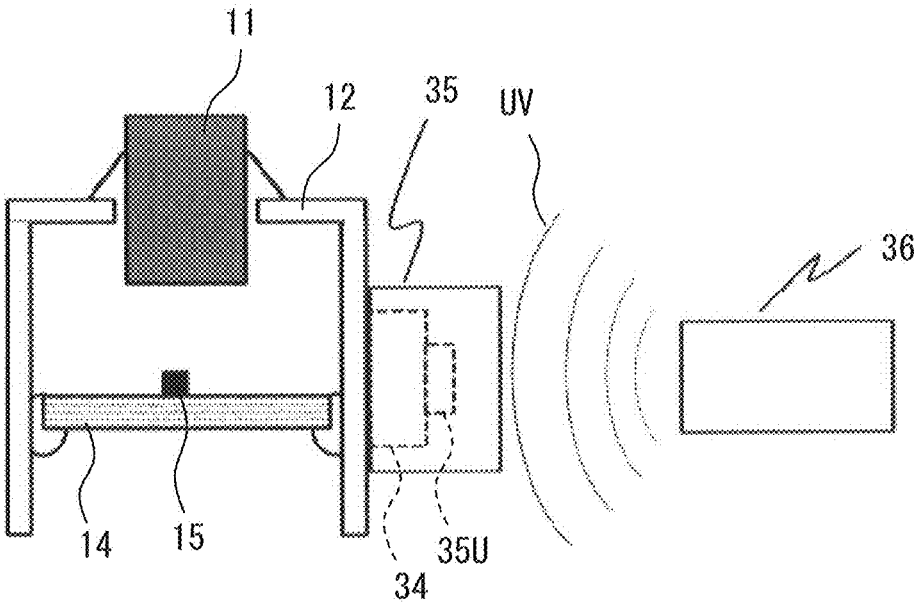
FIG. 13B schematically illustrates a process following the process illustrated in FIG. 13A.
Figure 13C:
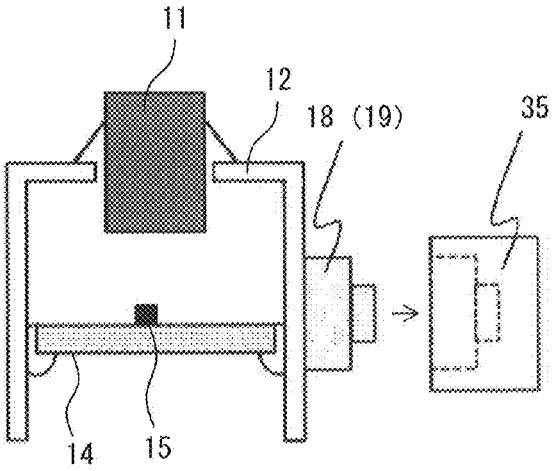
FIG. 13C schematically illustrates a process following the process illustrated in FIG. 13B.

Specifically, referring to FIG. 13A, UV curable resin 34 may be first applied, with a dispenser, to the side surface of the holder 12 around a position that is shifted from the mark 12M in the X-axis direction by the shift amount $X_O$. Thereafter, referring to FIG. 13B, a mold member 35 may be pressed against the UV resin 34. The mold member 35 may have a concave 35U that has a predetermined shape. It is preferable that a surface of the concave 35U be subjected to a release process such as silicone coating and fluorine coating. The mold member 35 may be moved in the X-axis direction and the Y-axis direction on the basis of the shift amounts $X_O$ and $Y_O$ while the mold member 35 is pressed against the UV resin 34. The position, of the mold member 35, in the X-axis direction and the position, of the mold member 35, in the Y-axis direction may be thereby determined. Thereafter, UV light may be applied by an external UV applying apparatus 36 to the UV curable resin 34, curing the UV curable resin 34. Referring to FIG. 13C, lastly, the mold member 35 may be removed. The engagement part 18 (or 19) may be thus formed at the predetermined position in the side surface of the holder 12.

[Workings of Exposure Unit 10]

The exposure unit 10 may have a configuration in which, upon application of a voltage to the light emitting devices 15 in the light-emitting device array LU, each of the light emitting devices 15 emits the light beam L15 illustrated in FIG. 6 having predetermined intensity in accordance with the applied voltage. Each of the light beams L15 emitted from the respective light emitting devices 15 may enter the rod lens 23 to be imaged by the rod lens 23, exiting from the rod lens 23 as the light beam L11. The light beam L11 may travel directly toward the object such as the photosensitive drum 41 on which exposure is to be performed.

[Outline Configuration of Image Forming Apparatus 100]

Figure 14:
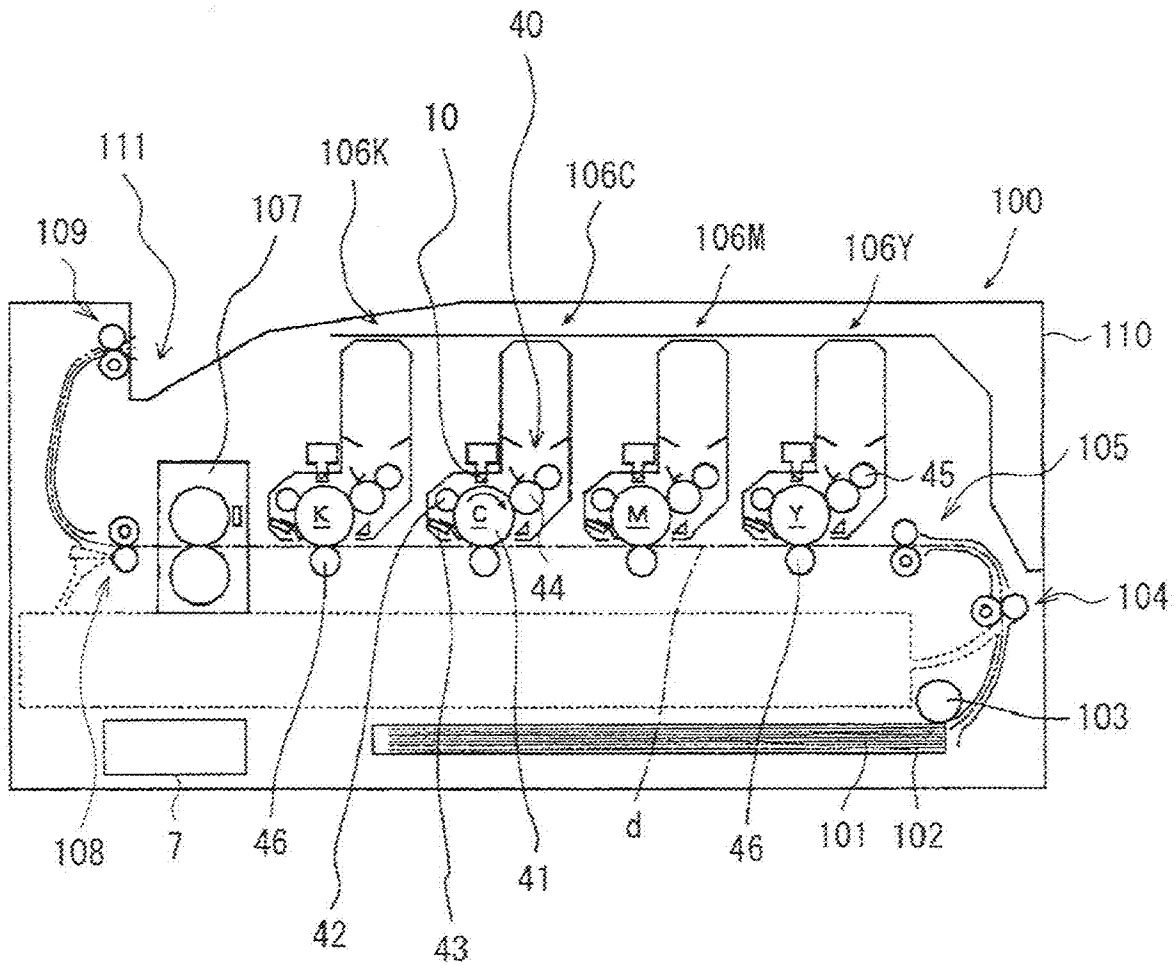
FIG. 14 schematically illustrates an example of an overall configuration of an image forming apparatus on which the exposure unit illustrated in FIG. 1 is mounted.

FIG. 14 schematically illustrates an example of an overall configuration of an image forming apparatus 100 with the foregoing exposure unit 10. The image forming apparatus 100 may be an electrophotographic printer that forms an image such as a color image on a medium, for example. The medium may be also referred to as a print medium or a transfer member. Non-limiting examples of the medium may include a sheet and a film. The image forming apparatus 100 may correspond to an "image forming apparatus" according to one specific but non-limiting embodiment of the technology.

Referring to FIG. 14, the image forming apparatus 100 may include a medium feeding cassette 102, a medium feeding roller (a hopping roller) 103, a pair of conveying rollers 104, a pair of conveying rollers 105, four image forming units (four process units), i.e., image forming units (process units) 106Y, 106M, 106C, and 106K, a fixing unit 107, a pair of discharging rollers 108, and a pair of discharging rollers 109, for example. The foregoing members may be disposed inside a housing 110 in order from upstream toward downstream, for example. A stacker 111 may be provided at an upper part of the housing 110. Further, the image forming apparatus 100 may include an external interface unit and a controller 7. The external interface unit may be built in the image forming apparatus 100, and receive print data from an external apparatus such as a personal computer (PC). The controller 7 may perform an overall operation control of the image forming apparatus 100.

The medium feeding cassette 102 may contain media 101 in a stacked state. The medium feeding cassette 102 may be provided attachably and detachably at a lower part of the image forming apparatus 100, for example.

The medium feeding roller 103 may pick up the media 101 separately one by one from the top of the media 101 contained in the medium feeding cassette 102, and feed the medium 101 picked up toward the pair of conveying rollers 104. In other words, the medium feeding roller 103 may serve as a medium feeding mechanism.

Each of the pair of conveying rollers 104 and the pair of conveying rollers 105 may sequentially sandwich the media 101 fed from the medium feeding roller 103 and convey the media 101 toward the image forming units 106Y, 106M, 106C, and 106K while correcting a skew of each of the media 101.

The image forming units 106Y, 106M, 106C, and 106K may be disposed in order from the upstream toward the downstream along a conveying path "d" of the medium 101 illustrated by a dashed line in FIG. 14. The conveying path "d" may have an "S" shape as a whole in this example, as illustrated in FIG. 14. The image forming units 106Y, 106M, 106C, and 106K may each correspond to an "image forming unit" according to one specific but non-limiting embodiment of the technology.

The respective image forming units 106Y, 106M, 106C, and 106K may form images (toner images) on the medium 101 using toners (developers) having colors different from each other. Specifically, the image forming unit 106Y may form a yellow toner image using a yellow (Y) toner. Similarly, the image forming unit 106M may form a magenta toner image using a magenta (M) toner. The image forming unit 1060 may form a cyan toner image using a cyan (C) toner. The image forming unit 106K may form a black toner image using a black (K) toner.

The foregoing toner of each of the colors may include agents such as a predetermined coloring agent, a predetermined release agent, a predetermined electric charge control agent, and a predetermined treatment agent, for example. Components of the respective agents described above may be mixed as appropriate or subjected to a surface treatment. The toner may be thus manufactured. The coloring agent, the release agent, and the electric charge control agent out of the foregoing agents may serve as internal additives. Further, an additive such as silica and titanium oxide may be included as an external additive, and resin such as polyester resin may be included as binding resin. As the coloring agent, an agent such as a dye and a pigment may be used solely, or a plurality of agents such as a dye and a pigment may be used in combination.

The image forming units 106Y, 106M, 106C, and 106K may have the same configuration except that the colors of the toners used to form the toner images (the developer images) are different from each other as described above. Hence, the image forming units 106Y, 106M, 106C, and 106K may be collectively referred to as an image forming unit 106 below, and a configuration of the image forming unit 106 is described below.

Referring to FIG. 14, the image forming unit 106 may include a toner cartridge 40 (a developer container), the photosensitive drum 41 (an image supporting member), a charging roller 42 (a charging member), a developing roller 44 (a developer supporting member), a feeding roller 45 (a feeding member), a cleaning blade 43, and the exposure unit 10.

The toner cartridge 40 may be a container that contains the foregoing toner of each of the colors. Specifically, the toner cartridge 40 in the image forming unit 106Y may contain the yellow toner, for example. Similarly, the toner cartridge 40 in the image forming unit 106M may contain the magenta toner. The toner cartridge 40 in the image forming unit 106C may contain the cyan toner. The toner cartridge 40 in the image forming unit 106K may contain the black toner.

The photosensitive drum 41 may have a surface (a surficial part) supporting an electrostatic latent image. The photosensitive drum 41 may include a photoreceptor such as an organic photoreceptor. Specifically, the photosensitive drum 41 may include an electrically-conductive supporting body and a photoconductive layer that covers a circumferential part (a surface) of the electrically-conductive supporting body. The electrically-conductive supporting body may include a metal pipe made of aluminum, for example. The photoconductive layer may have a structure including an electric charge generation layer and an electric charge transfer layer that are stacked in order, for example. It is to be noted that the foregoing photosensitive drum 41 may rotate at a predetermined circumferential velocity.

The charging roller 42 may electrically charge the surface 41S of the photosensitive drum 41. The charging roller 42 may be so disposed as to be in contact with the surface 41S of the photosensitive drum 41. The charging roller 42 may include a metal shaft and an electrically-semiconductive rubber layer that covers an outer circumferential part (a surface) of the metal shaft, for example. Non-limiting examples of the electrically-semiconductive rubber layer may include an electrically-semiconductive epichlorohydrin rubber layer. It is to be noted that the charging roller 42 may rotate in a direction opposite to a rotation direction of the photosensitive drum 41, for example.

The developing roller 44 may have a surface supporting the toner that develops the electrostatic latent image. The developing roller 44 may be so disposed as to be in contact with the surface (the circumferential surface) of the photosensitive drum 41. The developing roller 44 may include a metal shaft and an electrically-semiconductive urethane rubber layer that covers an outer circumferential part (a surface) of the metal shaft. It is to be noted that the foregoing developing roller 44 may rotate in a direction opposite to the rotation direction of the photosensitive drum 41 at a predetermined circumferential velocity, for example.

The feeding roller 45 may feed the toner contained inside the toner cartridge 40 to the developing roller 44. The feeding roller 45 may be so disposed as to be in contact with a surface (a circumferential surface) of the developing roller 44. The feeding roller 45 may include a metal shaft and a foamed silicone rubber layer that covers an outer circumferential part (a surface) of the metal shaft, for example. It is to be noted that the feeding roller 45 may rotate in a direction same as the rotation direction of the developing roller 44, for example.

The cleaning blade 43 may scrape the toner remained on the surface (the surficial part) of the photosensitive drum 41 to thereby remove the remained toner from the surface (the surficial part) of the photosensitive drum 41. In other words, the cleaning blade 43 may clean the surface (the surficial part) of the photosensitive drum 41. The cleaning blade 43 may be so disposed as to be in contact with the surface of the photosensitive drum 41 in a counter direction. In other words, the cleaning blade 43 may be so disposed as to protrude in a direction opposite to the rotation direction of the photosensitive drum 41. The cleaning blade 43 may be made of an elastic material such as polyurethane rubber, for example.

The exposure unit 10 may be the one described above according to the example embodiment. The exposure unit 10 may selectively apply, on the basis of the image data, application light onto the surface 41S of the photosensitive drum 41 electrically charged by the charging roller 42. The exposure unit 10 may thus perform exposure on the surface of the photosensitive drum 41, and thereby form an electrostatics latent image on the surface 41S (the surficial part) of the photosensitive drum 41. The exposure unit 10 may be supported by the housing 110, for example.

The transfer roller 46 may electrostatically transfer, onto the medium 101, the toner image formed inside each of the image forming units 106Y, 106M, 106C, and 106K. The transfer roller 46 may be so disposed as to face each of the photosensitive drums 41 in the respective image forming units 106Y, 106M, 106C, and 106K. It is to be noted that the transfer roller 46 may be made of a foamed electrically-semiconductive elastic rubber material, for example.

The fixing unit 107 may apply heat and pressure to the toner (the toner image) on the medium 101 conveyed from the image forming unit 106K, and thereby fix the toner image onto the medium 101. The fixing unit 107 may include a heating unit and a pressure-applying roller that are so disposed as to face each other with the conveying path "d" of the medium 101 in between, for example. It is to be noted that the fixing unit 107 may be integrally attached to the image forming apparatus 100, or may be attachably and detachably attached to the image forming apparatus 100, for example.

The pair of discharging rollers 108 and the pair of discharging rollers 109 may each guide the medium 101 when the medium 101 onto which the toner is fixed by the fixing unit 107 is to be discharged to outside of the image forming apparatus 100. The medium 101 that has been discharged to the outside of the housing 110 after sequentially passing through the pair of discharging rollers 108 and the pair of discharging rollers 109 may be discharged in a face-down state toward the stacker 111 provided at the upper part of the housing 110. It is to be noted that the stacker 111 may be a part in which the media 101 on each which an image is formed (printed) are to be accumulated.

[Operations and Workings]

[A. Basic Operation]

The image forming apparatus 100 may transfer the toner image onto the medium 101 in the following manner. In other words, the image forming apparatus 100 may perform a printing operation in the following manner.

When the print image data and printing order are supplied from an external device such as a PC to the controller 7 in the image forming apparatus 100 in an operating state, the controller 7 may start the printing operation of the print image data according to the printing order.

For example, referring to FIG. 14, the media 101 contained in the medium feeding cassette 102 may be picked up one by one from the top by the medium feeding roller 103. The medium 101 picked up may be conveyed by members such as the pair of conveying rollers 104 and the pair of conveying rollers 105 while a skew of the medium 101 is corrected by the members such as the pair of conveying rollers 104 and the pair of conveying rollers 105. The medium 101 may be thus conveyed to the image forming units 106Y, 106M, 106C, and 106K provided downstream of the members such as the pair of conveying rollers 104 and the pair of conveying rollers 105. The image forming units 106Y, 106M, 106C, and 106K may each transfer the toner image onto the medium 101 in the following manner.

In each of the image forming units 106Y, 106M, 106C, and 106K, the toner image of each of the colors may be formed through the following electrophotographic process according to the printing order given by the controller 7. Specifically, the controller 7 may activate a driver to cause the photosensitive drum 41 to rotate in a predetermined rotation direction at a constant velocity. In accordance with the rotation of the photosensitive drum 41, the members such as the charging roller 42, the developing roller 44, and the feeding roller 45 may each start a rotation operation in a predetermined direction.

The controller 7 may apply a predetermined voltage to the charging roller 42 for each of the colors, to thereby electrically charge the surface of the photosensitive drum 41 for each of the colors uniformly. Thereafter, the controller 7 may supply a control signal to the exposure unit 10 to thereby activate the exposure unit 10. The activated exposure unit 10 may apply, onto the respective photosensitive drums 41 of the respective colors, light beams corresponding to the respective color components of the print image based on the image data, thereby forming the electrostatic latent images on the surfaces 41S of the photosensitive drums 41 of the respective colors.

The toner contained inside the toner cartridge 40 may be fed to the developing roller 44 via the feeding roller 45. The fed toner may be supported by the surface of the developing roller 44. The developing roller 44 may attach the toner to the electrostatic latent image formed on the photosensitive drum 41 to thereby form the toner image. Further, the transfer roller 46 may receive a voltage, leading to generation of an electric field between the photosensitive drum 41 and the transfer roller 46. When the medium 101 passes between the photosensitive drum 41 and the transfer roller 46 in such a state, the toner image formed on the photosensitive drum 41 may be transferred onto the medium 101.

Thereafter, the toner images on the medium 101 may be applied with heat and pressure by the fixing unit 107, to be thereby fixed onto the medium 101. Finally, the medium 101 onto which the toner images are fixed may be discharged, by the pair of discharging rollers 108 and the pair of discharging rollers 109, to the outside and stocked in the stacker 111. This may bring the printing operation performed on the medium 101 to the end.

[B. Workings and Effects of Exposure Unit 10]

The exposure unit 10 may cause each of the light emitting devices 15 to emit a light beam having a predetermined light amount, on the basis of the control signal supplied from the controller 7. The light beams L15 emitted from the respective light emitting devices 15 may enter the lens array 11. Thereafter, the light beams L15 that have entered the lens array 11 may exit, as the light beams L11, from the lens array 11 to be imaged on the surface 41S of the photosensitive drum 41. It may be required that the imaging positions of the light beams L11 that derive from the respective light emitting devices 15 and travel to the surface 41S via the lens array 11 be within a predetermined range. For example, it may be required that the imaging positions of such light beams L11 fall within a range satisfying a standard value.

The exposure unit 10 according to the first example embodiment may include the plurality of exposure heads 1 (1A to 1C) that are integrated together with each other owing to the joining of the engagement parts 18 with each other and the joining of the engagement parts 19 with each other. Each of the engagement parts 18 and 19 of the exposure heads 1 may be fixed in advance, by a method such as adhesion, to the position, in the side surface of the holder 12, that is based on the imaging position of the lens array 11. Accordingly, upon manufacturing of the exposure unit 10, a complicated operation is avoidable after forming the joints C18 and C19 by joining together the engagement parts 18 with each other and joining together the engagement parts 19 with each other. The complicated operation upon the manufacturing of the exposure unit 10 may include adjustment of focusing of each of the exposure heads 1 and adjustment of a gap between the light emitting devices 15 of the exposure heads 1 that are adjacent to each other. For example, the joint C18 illustrated in FIG. 5 may be provided only by fitting the engagement part 18A and the engagement part 18B into each other. Similarly, the joint C19 illustrated in FIG. 4 may be provided only by fitting the engagement part 19B and the engagement part 19C into each other. As a result, the process of manufacturing the exposure unit 10 is simplified, which is advantageous in reduction of time necessary for manufacturing.

Moreover, the engagement parts 18 and the engagement parts 19 of the exposure heads 1A to 1C may each be attached at a predetermined position that is adjusted in advance. Therefore, upon configuring of the exposure unit 10, the order of joining together the exposure heads 1A to 1C with each other, the positions at which the exposure heads 1A to 1C are disposed with respect to the base holder 20, and any other factor are therefore not limited to those illustrated in FIGS. 1 and 3. Specifically, FIGS. 1 and 3 illustrate an example case in which the exposure head 1B is disposed in the middle in the X-axis direction, and the exposure head 1A and the exposure head 1C are disposed on both side of the exposure head 1B. However, the positions at which the exposure heads 1A to 1C are disposed may be optionally switched between each other. For example, the exposure head 1A may be disposed in the middle, and the exposure head 1B and the exposure head 1C may be disposed on both side of the exposure head 1A. Accordingly, there is no particular limitation in selecting the exposure heads 1 upon the manufacturing of the exposure unit 10. A reduction in quantity of the exposure heads 1 in stock, a reduction in time necessary for operation of joining together the exposure heads 1 are therefore expectable.

2. Second Example Embodiment

Figure 15A:
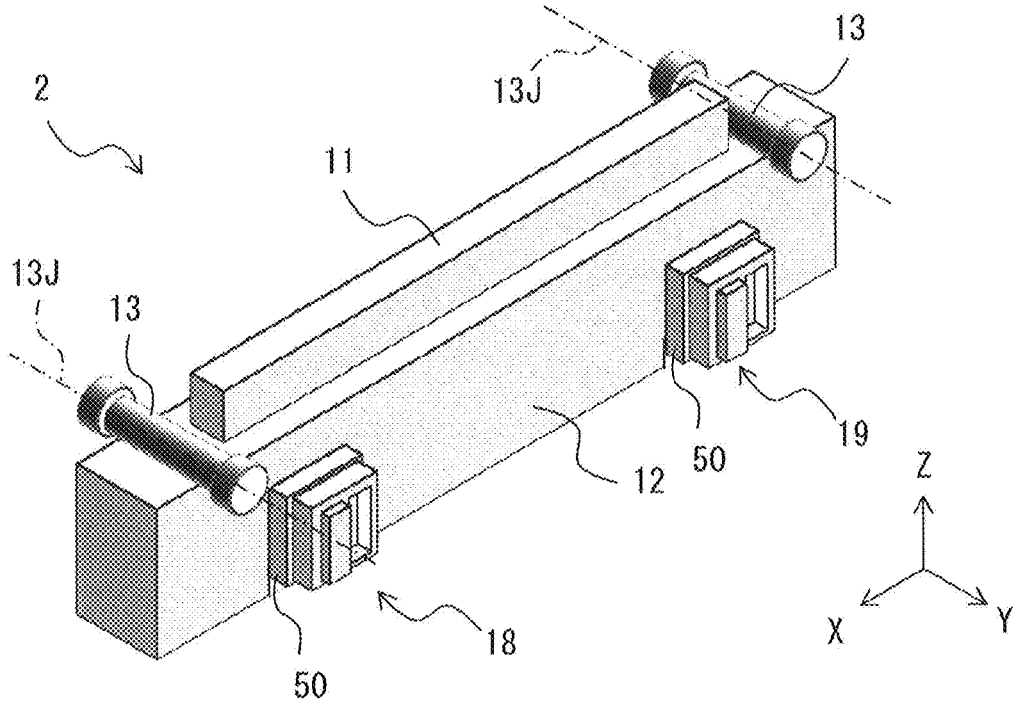
FIG. 15A is a perspective view of an example of an overall configuration of an exposure head according to a second example embodiment of the technology.
Figure 15B:
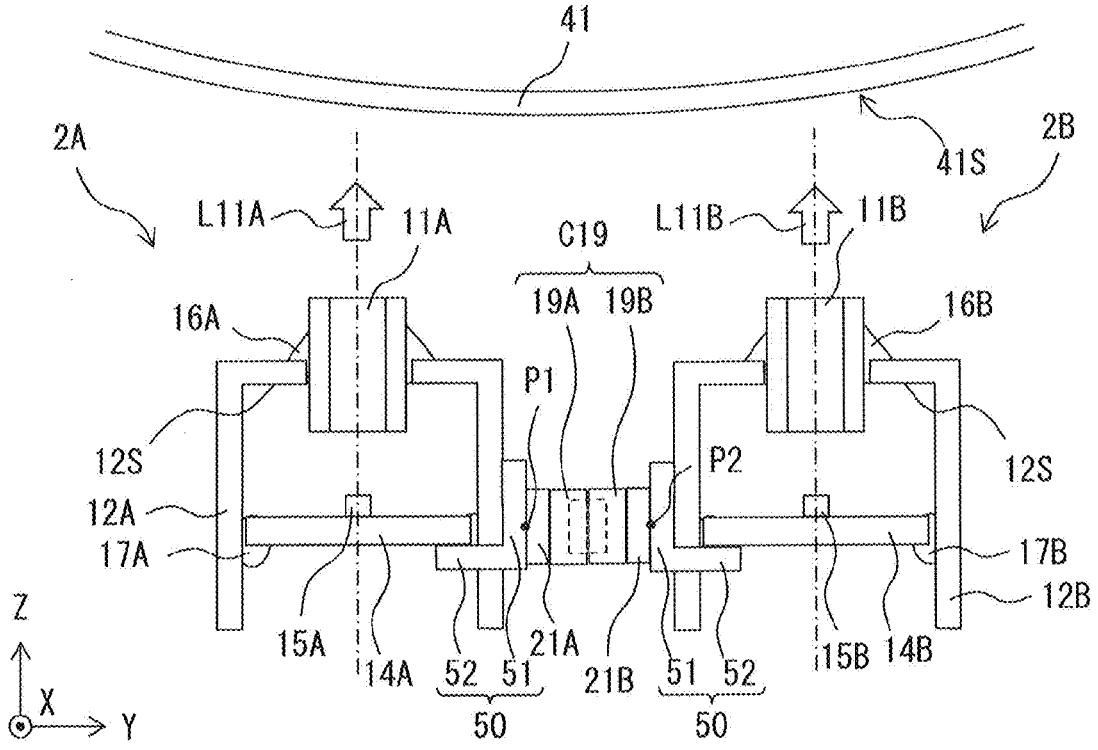
FIG. 15B is a cross-sectional view of the exposure head illustrated in FIG. 15A.

FIG. 15A is a perspective view of an example of an overall configuration of an exposure head 2 (2A or 2B) according to a second example embodiment of the technology. FIG. 15B is a cross-sectional view of the exposure head 2A and the exposure head 2B that are joined together with each other at the joint C19. FIG. 15B omits illustration of the biasing member 22. The exposure head 2A and the exposure head 2B may have configurations that are substantially the same as each other.

The exposure head 2 may have a configuration that is substantially similar to the configuration of the exposure head 1 according to the first example embodiment, except that a pedestal 50 may be provided between the holder 12 and the engagement part 18 and another pedestal 50 may be provided between the holder 12 and the engagement part 19. Accordingly, the description below mainly refers to the pedestals 50 and the vicinities of the pedestals 50. Components other than the pedestals 50 and those in the vicinities of the pedestals 50 are denoted by numerals same as those in the first example embodiment and are not described further where appropriate.

Referring to FIGS. 15A and 15B, the exposure head 2A may include the pedestal 50 that is disposed between the holder 12 and the engagement part 18 and the pedestal 50 that is disposed between the holder 12 and the engagement part 19. The pedestals 50 may each have a cross-section having an "L" shape. The pedestals 50 may include a resin member, for example. The pedestal 50 may include a first part 51 that is provided on the side surface of the holder 12, and a second part 52 that extends in the Y-axis direction from the side surface of the holder 12 through a side wall of the holder 12, for example. The pedestal 50 may be fixed to the device substrate 14 of the light-emitting device array LU with an adhesive agent or by any other fixing method. Specifically, the vicinity of a tip end of the second part 52 of the pedestal 50 may be fixed to the device substrate 14 of the light-emitting device array LU. The pedestal 50 and the holder 12 may not be fixed directly to each other. A mark 51M illustrated in FIG. 16A and other diagrams described later may be provided, on a surface of the first part 51 of the pedestal 50, at a position that serves as a reference upon the attachment of each of the engagement parts 18 and 19. The marks 51M may be a concave that is formed by a protruding process, for example.

[Method of Manufacturing Exposure Unit with Exposure Head 2]

A method of manufacturing an exposure unit with the exposure head 2 may be substantially the same as the method of manufacturing the exposure unit 10 with the exposure head 1, except that a process of fixing the pedestal 50 to the device substrate 14 is additionally provided. Specifically, for example, a step involving the fixing of the pedestal 50 to the device substrate 14 with the adhesive agent or by any other fixing method may be additionally provided between the step S101 and the step S102 in the flow illustrated in FIG. 9A. Further, in the step S105 illustrated in FIG. 9A, the engagement parts 18 and 19 may be fixed to the respective pedestals 50 by adhesion or any other fixing method, instead of being adhered to the holder 12, for example.

Figure 16A:
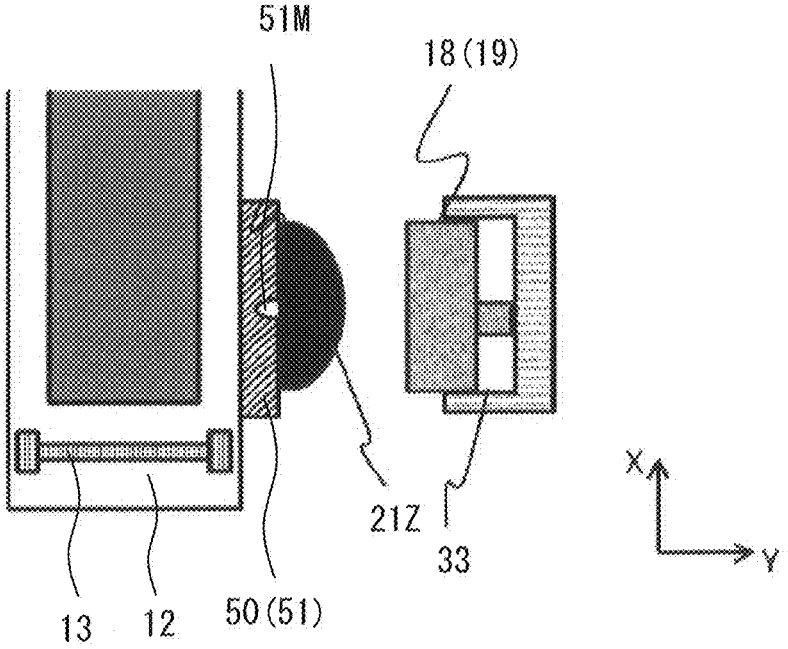
FIG. 16A schematically illustrates a process to be performed upon fixing an engaging part to a base member in the exposure head illustrated in FIG. 15A.

Specifically, referring to FIG. 16A, first, the adhesive agent 21Z may be applied, with a dispenser, on a side surface of the first part 51 of the pedestal 50 around a position that is shifted from the mark 51M in the X-axis direction by the shift amount $X_O$.

Figure 16B:
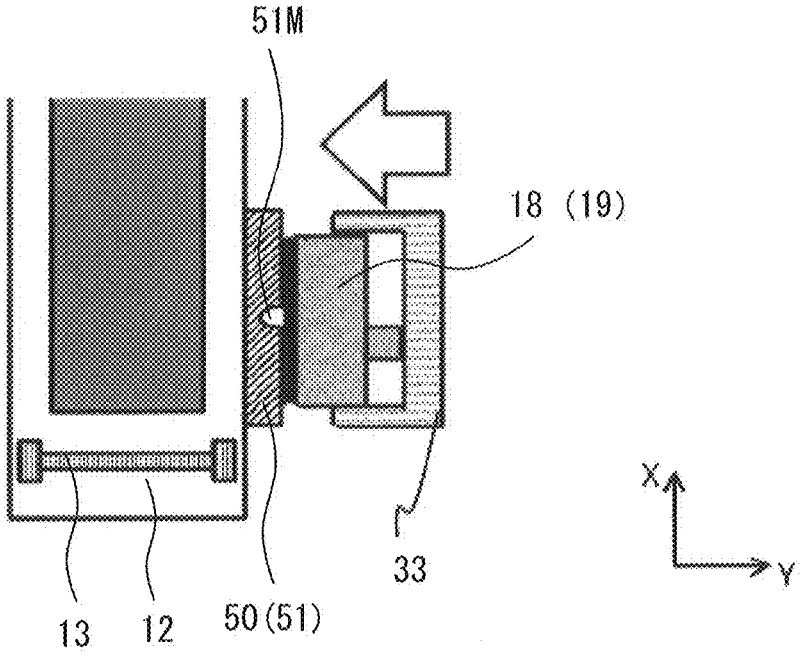
FIG. 16B schematically illustrates a process following the process illustrated in FIG. 16A.
Figure 16C:
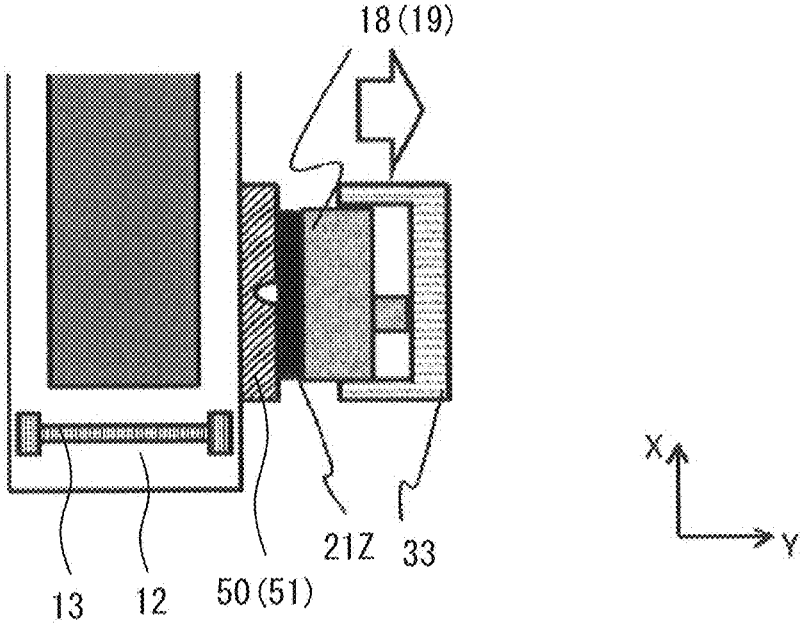
FIG. 16C schematically illustrates a process following the process illustrated in FIG. 16B.
Figure 16D:
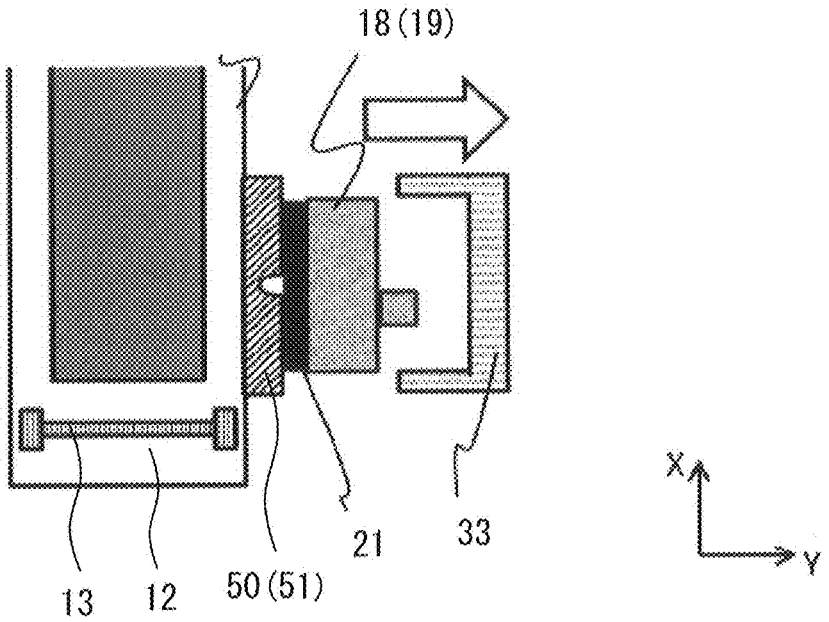
FIG. 16D schematically illustrates a process following the process illustrated in FIG. 16C.

Thereafter, the engagement part 18 (or 19) adsorbed onto the adsorption jig 33 may be brought closer to the adhesive agent 21Z applied onto the first part 51, and the engagement part 18 (or 19) may be pressed against the first part 51 in the −Y direction and thereby crush the adhesive agent 21Z as illustrated in FIG. 16B. Thereafter, referring to FIG. 16C, the position of the engagement part 18 (or 19) in the Y-axis direction may be adjusted by pulling back the adsorption jig 33 in the +Y direction, thereby holding the engagement part 18 (or 19) at the position in the Y-axis direction in accordance with the shift amount $Y_O$. This state may be maintained until the adhesive agent 21Z is cured. After the adhesive agent 21Z is cured, the engagement part 18 (or 19) may be released from the adsorption onto the adsorption jig 33. The adsorption jig 33 may be detached from the engagement part 18 (or 19) as illustrated in FIG. 16D.

[Workings and Effects of Exposure Unit with Exposure Heads 2]

According to the second example embodiment, for each of the exposure heads 2, the pedestals 50 may be fixed to the device substrate 14 on which the plurality of light emitting devices 15 are provided and the engagement parts 18 and 19 may be provided on the respective pedestals 50. Accordingly, the exposure unit according to the second example embodiment may have a configuration in which the device substrates 14 of the respective exposure heads 2 are integrated with each other owing to the joining of the engagement parts 18 and 19. This makes it possible to reduce a shift in spacing between the light emitting devices 15A in the exposure head 2A and the light emitting devices 15B in the exposure head 2B even when the device substrates 14 expand or contract due to a variation in conditions such as a temperature condition and a humidity condition. As a result, it is possible for the image forming apparatus with the exposure heads 2 to reduce a shift in position of an image to be formed, achieving an image with higher quality.

Moreover, according to the second example embodiment, for each of the exposure heads 2, the engagement parts 18 and 19 may each be fixed in advance by adhesion or any other fixing method, at a position, in the side surface of the first part 51 of the pedestal 50, that is based on the imaging position of the lens array 11. As a result, the second example embodiment also allows for simplification, as with the first example embodiment, of the process of manufacturing the exposure unit, which is advantageous in reduction of time necessary for manufacturing.

3. Third Example Embodiment

[Configuration of Exposure Head 3]

Figure 17A:
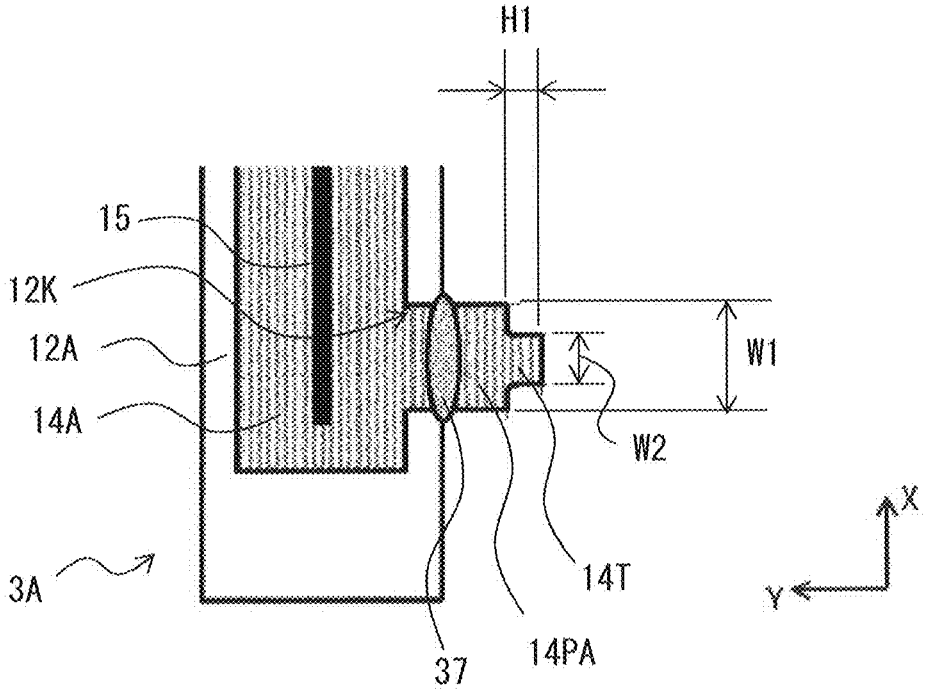
FIG. 17A is a cross-sectional view of a configuration example of a key part of an exposure head according to a third example embodiment of the technology.
Figure 17B:
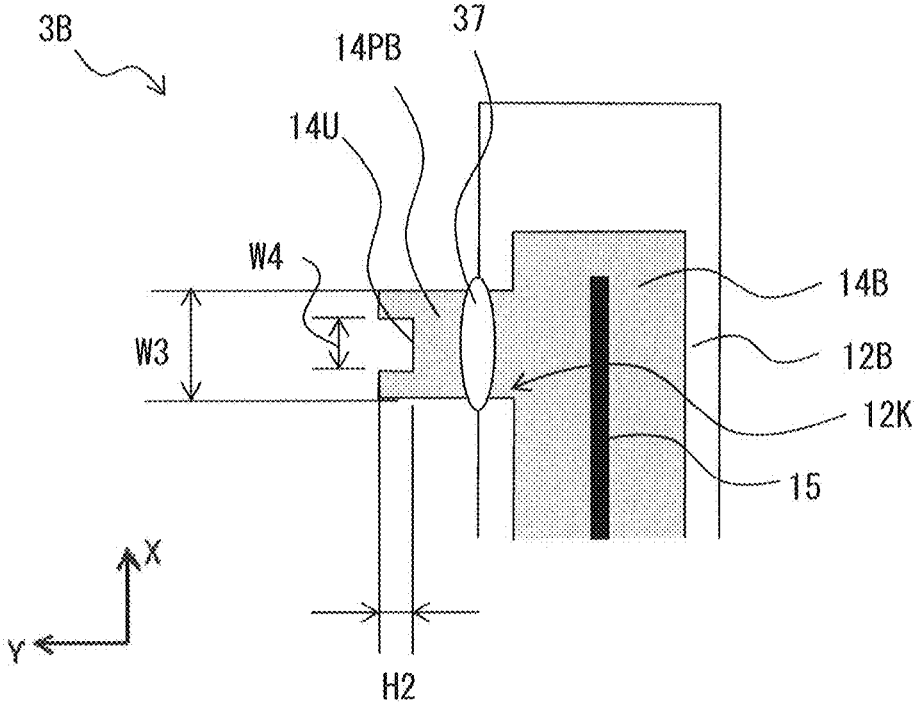
FIG. 17B is another cross-sectional view of the configuration example of the key part of the exposure head according to the third example embodiment of the technology.
Figure 18A:
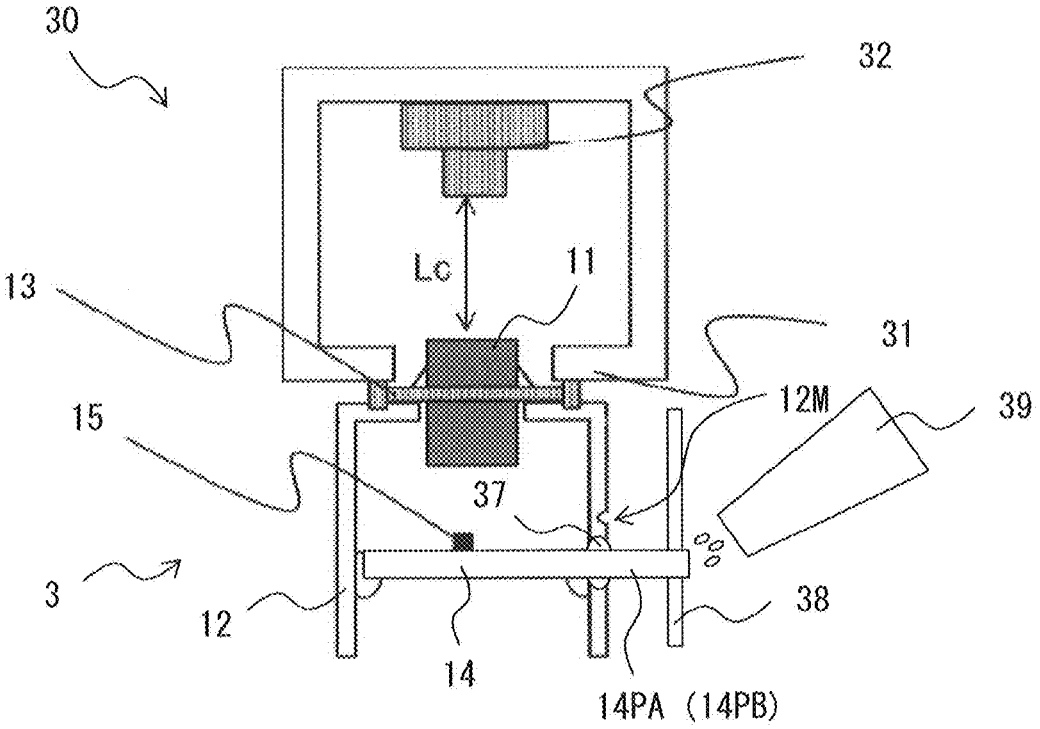
FIG. 18A schematically illustrates a process in a method of manufacturing the exposure head illustrated in FIG. 17A.
Figure 18B:
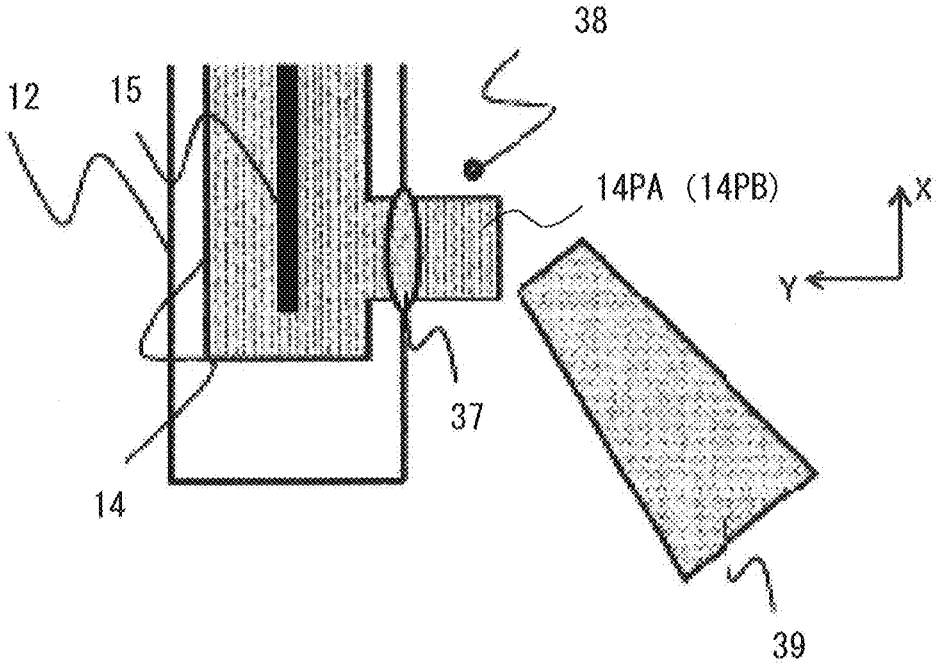
FIG. 18B schematically illustrates a process in the method of manufacturing the exposure head illustrated in FIG. 17A.
Figure 18C:
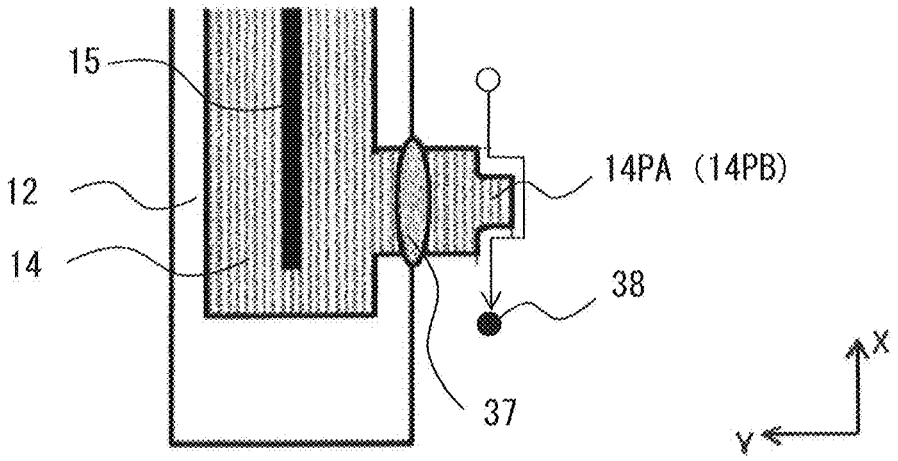
FIG. 18C schematically illustrates a process in the method of manufacturing the exposure head illustrated in FIG. 17A.

FIGS. 17A and 17B are each an enlarged cross-sectional view of a configuration example of a key part of an exposure head 3 (3A or 3B) according to a third example embodiment of the technology. FIG. 18A is a cross-sectional view of the exposure head 3 in a process of a method of manufacturing the exposure head 3. FIGS. 18B and 18C are each a plan view of the exposure head 3 in a process of the method of manufacturing the exposure head 3. The exposure head 3A and the exposure head 3B may have configurations that are substantially the same as each other except for a shape of the engagement part.

The exposure head 3 may have a configuration in which part of the device substrate 14 protrudes to the outside of the holder 12. A tip end of the protruding part of the device substrate 14 may serve as the engagement part. Hence, the exposure head 3 may not include the engagement parts 18 and 19 as independent members.

Specifically, referring to FIG. 17A, the device substrate 14A of the exposure head 3A may include a protrusion 14PA that protrudes from inside of the holder 12A to outside of the holder 12A through an opening 12K, for example. A convex 14T may be provided at a tip end of the protrusion 14PA, for example. The protrusion 14PA may have a width W1 in the X-axis direction that is about 15 mm, for example. The convex 14T may have a width W2 in the X-axis direction that is about 7 mm, for example, and may have a height H1 in the Y-axis direction that is about 5 mm, for example.

Referring to FIG. 17B, the device substrate 14B of the exposure head 3B may include a protrusion 14PB that protrudes from inside of the holder 12B to outside of the holder 12B through an opening 12K, for example. A concave 14U may be provided at a tip end of the protrusion 14PB, for example. The concave 14U may have a shape that is able to be fit into the convex 14T. The protrusion 14PB may have a width W3 in the X-axis direction that is about 15 mm, for example. The concave 14U may have a width W4 in the X-axis direction that is about 7 mm, for example, and may have a depth H2 in the Y-axis direction that is about 7 mm, for example.

Each of a gap between the opening 12K and the protrusion 14PA and a gap between the opening 12K and the protrusion 14PB may be preferably sealed by a sealant 37. The sealant 37 may be made of an elastic resin material such as silicone, for example. The exposure head 3 may have a configuration that is substantially similar to the configuration of the exposure head 1 according to the first example embodiment, except for the foregoing points.

The convex 14T of the protrusion 14PA and the concave 14U of the protrusion 14PB may be formed as the following, for example. Specifically, referring to FIG. 18A, the imaging position of each of the light beams L11 that derive from the respective light emitting devices 15 and pass through the lens array 11 may be measured with the optical image measuring apparatus 30. The imaging position to be measured may include a position in the X-axis direction, a position in the Y-axis direction, and a position in the Z-axis direction. Thereafter, the focal position, i.e., the imaging position in the Z-axis direction may be adjusted on the basis of a result of the measurement. Thereafter, a difference (shift amounts $X_O$ and $Y_O$) between a designed value and a measured value may be determined for each of spots of the light beams L11 that derive from the respective light emitting devices 15 and pass through the lens array 11. Further, referring to FIGS. 18A to 18C, the convex 14T having a predetermined shape may be formed at a position that is shifted from a reference position by the shift amount $X_O$ in the X-axis direction. The reference position may be an end edge of the device substrate 14 in the X-axis direction. The formation of such a convex 14T may be performed by a milling process, for example. In this example, a router (an end mill) 38 may perform scanning from a position indicated by a white circle (○) to a position indicated by a black circle (●) as indicated by an arrow of FIG. 18C. Milling may be thus performed on each of the tip ends of the respective protrusions 14PA and 14PB, for example. Upon the milling, debris of the milling may be preferably removed by a vacuum nozzle 39.

The exposure head 3A and the exposure head 3B may be joined together with each other as follows. Specifically, the exposure head 3A and the exposure head 3B may each be placed at a predetermined position in the back surface 20S illustrated in FIG. 5 of the base holder 20, for example. Thereafter, the holder 12A and the holder 12B may be biased by a biasing member 22A and a biasing member 22B toward the back surface 20S of the base holder 20. While the state in which the holder 12A and the holder 12B are biased toward the base holder 20 is maintained, the convex 14T of the protrusion 14PA of the device substrate 14A illustrated in FIG. 17A may be inserted into the concave 14U of the protrusion 14PB of the device substrate 14B illustrated in FIG. 17B. The convex 14T and the concave 14U may be adhered to each other with an adhesive agent and thereby fixed to each other. It is to be noted that a method of fixing the convex 14T and the concave 14U to each other is not limited to adhesion and may be any other method such as welding and fusing.

According to the third example embodiment, the protrusions 14PA and 14PB in each of the exposure heads 3 may be formed in advance at the position based on the imaging position of the lens array 11. Further, the plurality of exposure heads 3 may be integrated together with each other owing to the joining of the protrusions 14PA and 14PB, thus configuring the exposure unit. As a result, the process of manufacturing the exposure unit is simplified, which is advantageous in reduction of time necessary for manufacturing, as with the first example embodiment.

Moreover, the exposure unit according to the third example embodiment including the exposure heads 3 may also have a configuration in which the device substrates 14 of the respective exposure heads 3 are integrated together with each other. This makes it possible to reduce a shift in gap between the light emitting devices 15A in the exposure head 3A and the light emitting devices 15B in the exposure head 3B even when the device substrates 14 expand or contract due to a variation in conditions such as a temperature condition and a humidity condition. As a result, it is also possible for the image forming apparatus including the exposure heads 3 to reduce a shift in position of an image to be formed, achieving an image with higher quality.

4. Fourth Example Embodiment

[Configuration of Image Reader 200 with Light Receiving Unit 60]

Figure 19:
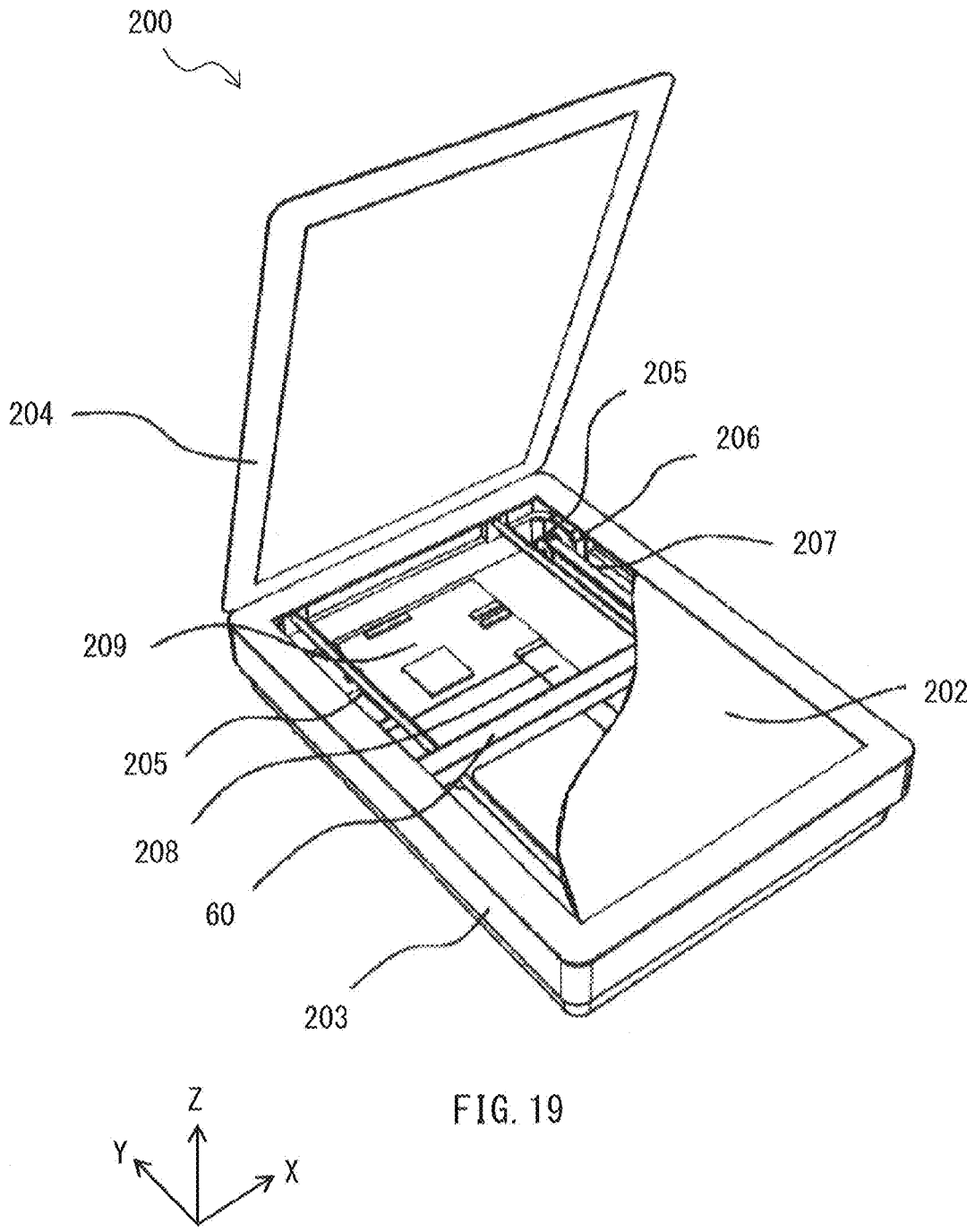
FIG. 19 is a perspective view of an example of an overall configuration of an image reader according to a fourth example embodiment of the technology.
Figure 20:
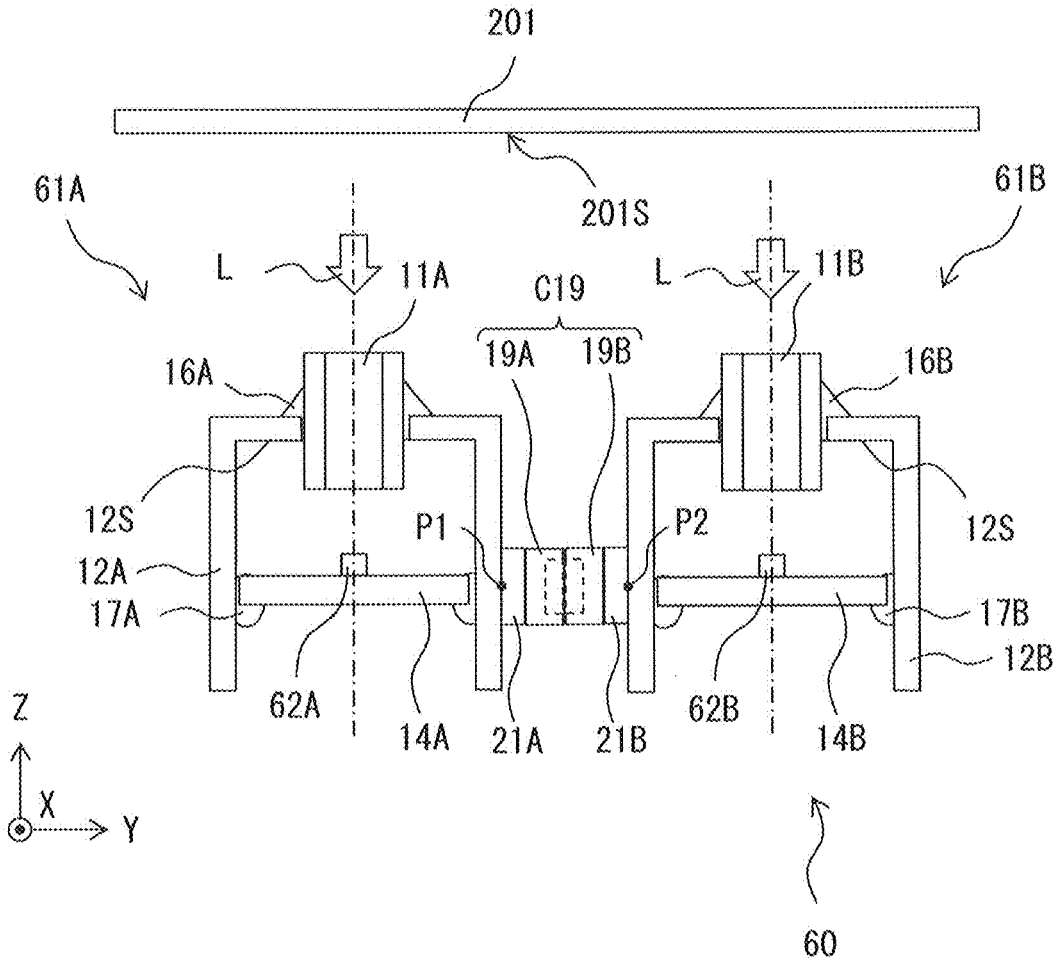
FIG. 20 is a cross-sectional view of a configuration example of a key part of a light receiving unit illustrated in FIG. 19.

FIG. 19 is a perspective view of an example of an overall configuration of an image reader 200 with a light receiving unit 60. FIG. 20 is a cross-sectional view of a configuration example of a key part of the light receiving unit 60.

The image reader 200 illustrated in FIG. 19 may be a so-called image scanner, for example. The image reader 200 may acquire, as electronic data, a component such as a text, a diagram, and a photograph provided on a document 201 illustrated in FIG. 20. The image reader 200 may include a housing 203 and a cover 204. The housing 203 may include, at a top of the housing 203, a placing surface 202 on which the document 201 to be read is to be placed. The cover 204 may face the placing surface 202 and be openable and closable. The image reader 200 may include, inside the housing 203, the light receiving unit 60, a pair of guiding members 205, a stepping motor 206, a driving belt 207, a flexible flat cable 208, and a control circuit 209. The pair of guiding members 205 may support the light receiving unit 60. The light receiving unit 60 may extend across the placing surface 202 in the X-axis direction, for example. The light receiving unit 60 may be supported by the pair of guiding members 205 at the both ends of the light receiving unit 60 in the X-axis direction. The pair of guiding members 205 may extend in the Y-axis direction. Accordingly, the light receiving unit 60 may be coupled to the driving belt 207, and be able to perform scanning across the placing surface 202 longitudinally in the Y-axis direction in accordance with rotation of the driving belt 207. The stepping motor 206 may be driven on the basis of an instruction supplied from the control circuit 209. The driving belt 207 may rotate owing to the driving of the stepping motor 206. Upon a reading operation, the cover 204 may be so closed that the cover 204 and the placing surface 202 sandwich the document 201 in between. The light receiving unit 60 may be coupled to the control circuit 209 by the flexible flat cable 208. The light receiving unit 60 may receive feeding from a power source via the flexible flat cable 208. The light receiving unit 60 may transmit a signal to the control circuit 209 and may receive a signal from the control circuit 209, via the flexible flat cable 208.

[Configuration of Light Receiving Unit 60]

Referring to FIG. 20, a detailed configuration of the light receiving unit 60 is described below. The light receiving unit 60 may include a plurality of light receiving heads 61 that are joined together with each other in the X-axis direction. The light receiving heads 61 may each have a configuration that is substantially the same as the configuration of the exposure head 1 described in the first example embodiment except that the light receiving heads 61 each include light receiving devices 62 instead of the light emitting devices 15. Specifically, a light beam L traveling from a surface 201S of the document 201 may pass through the lens array 11 and be imaged on a light receiving surface of the light receiving device 62, as illustrated in FIG. 20. The light beam L may be a reflected light beam of a light beam which a separately-provided application unit applies onto the surface 201S of the document 201, for example.

[Method of Manufacturing Light Receiving Unit 60]

The light receiving unit 60 may be manufactured by a method that is similar to the method of manufacturing the foregoing exposure unit 10 except that the device substrate 14 provided with the light receiving devices 62 instead of the light emitting devices 15 is prepared.

[Effects of Light Receiving Unit 60 and Image Reader 200]

Also in the light receiving unit 60 according to the fourth example embodiment, for each of the light receiving heads 61, the engagement parts 18 and 19 may each be fixed in advance, by adhesion or any other fixing method, at a position, in the side surface of the holder 12, that is based on the imaging position of the lens array 11, as with the foregoing exposure unit 10 according to the first example embodiment. Accordingly, upon manufacturing of the light receiving unit 60, a complicated operation is avoidable after forming the joints C18 and C19 by joining together the engagement parts 18 with each other and joining together the engagement parts 19 with each other. The complicated operation upon the manufacturing of the light receiving unit 60 may include adjustment of focusing of each of the light receiving heads 61 and adjustment of spacing between the light receiving devices 62 of the light receiving heads 61 that are adjacent to each other. As a result, the process of manufacturing the light receiving unit 60 is simplified, which is advantageous in reduction of time necessary for manufacturing.

5. Other Modification Examples

The technology is described above referring to the example embodiments and the modification examples thereof. However, the technology is not limited to the example embodiments and the modification examples thereof described above, and is modifiable in various ways. For example, the foregoing example embodiments are described referring to an example in which the lens array 11 includes the rod lenses 23 that are arranged in two rows. However, factors such as the arrangement positions and the number of the rod lenses are not limited to those described according to the foregoing example embodiment.

For example, the foregoing example embodiments are described referring to the image forming apparatus 100 of a primary transfer scheme (a direct transfer scheme). However, the technology is also applicable to a second transfer scheme.

The foregoing example embodiments and the modification examples thereof are described referring to the image forming apparatus having a printing function as an example corresponding to the "image forming apparatus" according to one specific but non-limiting embodiment of the technology. However, the function of the image forming apparatus is not limited thereto. Specifically, for example, the technology is also applicable to an image forming apparatus that serves as a multi-function peripheral having functions such as a scanner function and a facsimile function in addition to the printing function, for example.

The foregoing fourth example embodiment is described referring to an example of the light receiving head 61 having the engagement part 18, etc. that are fixed to the holder 12 with the adhesive agent 21. However, the light receiving head of the technology is not limited to the foregoing example. For example, the pedestal 50 fixed to the device substrate 14 may be provided, and the engagement part 18, etc. may be fixed to the pedestal 50, as described in the foregoing second example embodiment. Alternatively, part of the device substrate 14 may protrude to the outside of the holder 12, and the tip end of the protruding part may be processed to serve as the engagement part, as described in the foregoing third example embodiment.

Furthermore, the technology encompasses any possible combination of some or all of the various embodiments and the modifications described herein and incorporated herein.

It is possible to achieve at least the following configurations from the above-described example embodiments of the technology.

(1)

An exposure unit including:

a first exposure head including a plurality of first light emitting devices, a first optical system, a first coupler, and a first base member, the first light emitting devices being disposed side by side in a first direction and each emitting a first light beam, the first optical system facing the first light emitting devices in a second direction that intersects with the first direction, and performing imaging of each of the first light beams emitted by the respective first light emitting devices, the first coupler being provided at a first position, in the first base member, based on a position at which the imaging performed by the first optical system is performed, the first base member supporting the first light emitting devices, the first optical system, and the first coupler; and a second exposure head including a plurality of second light emitting devices, a second optical system, a second coupler, and a second base member, the second light emitting devices being disposed side by side in the first direction and each emitting a second light beam, the second optical system facing the second light emitting devices in the second direction, and performing imaging of each of the second light beams emitted by the respective second light emitting devices, the second coupler being provided at a second position, in the second base member, based on a position at which the imaging performed by the second optical system is performed and being fit into the first coupler, the second base member supporting the second light emitting devices, the second optical system, and the second coupler.

(2)

The exposure unit according to (1), further including a third exposure head including a plurality of third light emitting devices, a third optical system, a third coupler, and a third base member, the third light emitting devices being disposed side by side in the first direction and each emitting a third light beam, the third optical system facing the third light emitting devices in the second direction, and performing imaging of each of the third light beams emitted by the respective third light emitting devices, the third coupler being provided at a third position, in the third base member, based on a position at which the imaging performed by the third optical system is performed, the third base member supporting the third light emitting devices, the third optical system, and the third coupler, wherein the second exposure head further includes a fourth coupler that is supported by the second base member, the fourth coupler being provided at a fourth position, in the second base member, based on the position at which the imaging performed by the second optical system is performed, and the third coupler and the fourth coupler are fit into each other.

(3)

The exposure unit according to (1), wherein the first coupler and the second coupler are respectively fixed to the first base member and the second base member by one of adhesion, welding, fusing, and screwing.

(4)

The exposure unit according to any one of (1) to (3), wherein the first base member and the second base member have their respective shapes that are substantially same as each other, the first base member and the second base member have their respective dimensions that are substantially same as each other, and the first position relative to the first base member and the second position relative to the second base member are different from each other.

(5)

The exposure unit according to any one of (1) to (4), wherein each of the first optical system and the second optical system includes a plurality of rod lenses that are disposed side by side in the first direction.

(6)

The exposure unit according to any one of (1) to (5), wherein the first coupler is inserted into the second coupler in a third direction and is thereby fit into the second coupler, the third direction being different from both the first direction and the second direction.

(7)

An exposure unit including:

a first exposure head including a first substrate, a plurality of first light emitting devices, a first optical system, a first pedestal, a first coupler, and a first base member, the first light emitting devices being disposed side by side in a first direction on the first substrate and each emitting a first light beam, the first optical system facing the first light emitting devices in a second direction that intersects with the first direction, and performing imaging of each of the first light beams emitted by the respective first light emitting devices, the first pedestal being attached to the first substrate, the first coupler being provided at a first position, in the first pedestal, based on a position at which the imaging performed by the first optical system is performed, the first base member supporting the first substrate and the first optical system; and a second exposure head including a second substrate, a plurality of second light emitting devices, a second optical system, a second pedestal, a second coupler, and a second base member, the second light emitting devices being disposed side by side in the first direction on the second substrate and each emitting a second light beam, the second optical system facing the second light emitting devices in the second direction, and performing imaging of each of the second light beams emitted by the respective second light emitting devices, the second pedestal being attached to the second substrate, the second coupler being provided at a second position, in the second pedestal, based on a position at which the imaging performed by the second optical system is performed, and being fit into the first coupler, the second base member supporting the second substrate and the second optical system.

(8)

An exposure unit including:

a first exposure head including a first substrate, a plurality of first light emitting devices, a first optical system, and a first base member, the first substrate including a first engagement part that is provided at a first position based on a position at which imaging performed by the first optical system is performed, the first light emitting devices being disposed side by side in a first direction on the first substrate and each emitting a first light beam, the first optical system facing the first light emitting devices in a second direction that intersects with the first direction, and performing the imaging of each of the first light beams emitted by the respective first light emitting devices, the first base member supporting the first substrate and the first optical system; and a second exposure head including a second substrate, a plurality of second light emitting devices, a second optical system, and a second base member, the second substrate including a second engagement part that is provided at a second position based on a position at which imaging performed by the second optical system is performed, and is to be brought into engagement with the first engagement part, the second light emitting devices being disposed side by side in the first direction on the second substrate and each emitting a second light beam, the second optical system facing the second light emitting devices in the second direction, and performing the imaging of each of the second light beams emitted by the respective second light emitting devices, the second base member supporting the second substrate and the second optical system.

(9)

An image forming unit, including the exposure unit according to any one of (1) to (8).

(10)

An image forming apparatus, including the exposure unit according to any one of (1) to (8).

(11)

An exposure head including:

a plurality of light emitting devices that are disposed side by side in a first direction and each emit a light beam;

an optical system that faces the light emitting devices in a second direction, and performs imaging of each of the light beams emitted by the respective light emitting devices, the second direction intersecting with the first direction:

a coupler provided at a position, in a base member, based on a position at which the imaging performed by the optical system is performed; and the base member that supports the light emitting devices, the optical system, and the coupler.

(12)

A light receiving unit including:

a first light receiving head including a plurality of first light receiving devices, a first optical system, a first coupler, and a first base member, the first light receiving devices being disposed side by side in a first direction, the first optical system facing the first light receiving devices in a second direction that intersects with the first direction, and performing imaging of, on the first light receiving devices, respective first light beams entering the first optical system from outside, the first coupler being provided at a first position, in the first base member, based on a position at which the imaging performed by the first optical system is performed, the first base member supporting the first light receiving devices, the first optical system, and the first coupler; and a second light receiving head including a plurality of second light receiving devices, a second optical system, a second coupler, and a second base member, the second light receiving devices being disposed side by side in the first direction, the second optical system facing the second light receiving devices in the second direction, and performing imaging of, on the second light receiving devices, respective second light beams entering the second optical system from the outside, the second coupler provided at a second position, in the second base member, based on a position at which the imaging performed by the second optical system is performed, and being fit into the first coupler, the second base member supporting the second light receiving devices, the second optical system, and the second coupler.

(13)

An image reader, including the light receiving unit according to (12).

(14)

A method of manufacturing an exposure unit, the method including: preparing a first base member that supports a plurality of first light emitting devices and a first optical system, the first light emitting devices being disposed side by side in a first direction and each emitting a first light beam, the first optical system facing the first light emitting devices in a second direction that intersects with the first direction, and performing imaging of each of the first light beams emitted by the respective first light emitting devices;

providing a first coupler at a first position, in the first base member, based on a position at which the imaging performed by the first optical system is performed;

preparing a second base member that supports a plurality of second light emitting devices and a second optical system, the second light emitting devices being disposed side by side in the first direction and each emitting a second light beam, the second optical system facing the second light emitting devices in the second direction, and performing imaging of each of the second light beams emitted by the respective second light emitting devices;

providing a second coupler at a second position, in the second base member, based on a position at which the imaging performed by the second optical system is performed; and joining together the first base member and the second base member with each other by fitting the first coupler and the second coupler into each other.

(15)

The method according to (14), further including fixing the first coupler at the first position after the preparing of the first coupler.

(16)

A method of manufacturing an exposure unit, the method including:

preparing a first base member that supports a first substrate on which a plurality of first light emitting devices are provided and a first optical system, the first light emitting devices being disposed side by side in a first direction and each emitting a first light beam, the first optical system facing the first light emitting devices in a second direction that intersects with the first direction, and performing imaging of each of the first light beams emitted by the respective first light emitting devices;

attaching a first pedestal to the first substrate;

providing a first coupler at a first position, in the first pedestal, based on a position at which the imaging performed by the first optical system is performed;

preparing a second base member that supports a second substrate on which a plurality of second light emitting devices are provided and a second optical system, the second light emitting devices being disposed side by side in the first direction and each emitting a second light beam, the second optical system facing the second light emitting devices in the second direction, and performing imaging of each of the second light beams emitted by the respective second light emitting devices;

attaching a second pedestal to the second substrate;

providing a second coupler at a second position, in the second pedestal, based on a position at which the imaging performed by the second optical system is performed; and joining together the first substrate and the second substrate with each other by fitting the first coupler and the second coupler into each other.

(17)

A method of manufacturing an exposure unit, the method including:

preparing a first base member that supports a first substrate on which a plurality of first light emitting devices are provided and a first optical system, the first light emitting devices being disposed side by side in a first direction and each emitting a first light beam, the first optical system facing the first light emitting devices in a second direction that intersects with the first direction, and performing imaging of each of the first light beams emitted by the respective first light emitting devices;

processing part of the first substrate and thereby forming a first coupler at a first position, in the first substrate, based on a position at which the imaging performed by the first optical system is performed;

preparing a second base member that supports a second substrate on which a plurality of second light emitting devices are provided and a second optical system, the second light emitting devices being disposed side by side in the first direction and each emitting a second light beam, the second optical system facing the second light emitting devices in the second direction, and performing imaging of each of the second light beams emitted by the respective second light emitting devices;

processing part of the second substrate and thereby forming a second coupler at a second position, in the second substrate, based on a position at which the imaging performed by the second optical system is performed; and joining together the first substrate and the second substrate with each other by fitting the first coupler and the second coupler into each other.

(18)

A method of manufacturing a light receiving unit, the method including:

preparing a first base member that supports a plurality of first light receiving devices and a first optical system, the first light receiving devices being disposed side by side in a first direction, the first optical system facing the first light receiving devices in a second direction that intersects with the first direction, and performing imaging of, on the first light receiving devices, respective first light beams entering the first optical system from outside;

providing a first coupler at a first position, in the first base member, based on a position at which the imaging performed by the first optical system is performed;

preparing a second base member that supports a plurality of second light receiving devices and a second optical system, the second light receiving devices being disposed side by side in the first direction, the second optical system facing the second light receiving devices in the second direction, and performing imaging of, on the second light receiving devices, respective second light beams entering the second optical system from the outside;

providing a second coupler at a second position, in the second base member, based on a position at which the imaging performed by the second optical system is performed; and joining together the first base member and the second base member with each other by fitting the first coupler and the second coupler into each other.

(19)

A light receiving head corresponding to each of a plurality of light receiving heads that are joined together with each other and thereby configure a light receiving unit, the light receiving head including:

a plurality of light receiving devices that are disposed side by side in a first direction;

an optical system that faces the light receiving devices in a second direction intersecting with the first direction, and performing imaging of, on the light receiving devices, respective light beams entering the optical system from outside;

a coupler that is provided at a position, in the base member, based on a position at which the imaging performed by the optical system is performed; and a base member that supports the light receiving devices, the optical system, and the coupler.

In each of the exposure head, the exposure unit, the image forming unit, and the image forming apparatus according to one embodiment of the technology, the couplers are provided at the respective positions, in the corresponding base members, based on the position at which the imaging performed by the optical system is performed. This makes it possible to avoid operation such as adjustment of a focal point of each of the exposure heads that is to be performed after joining together the couplers with each other. As a result, the process of manufacturing is simplified, which is advantageous in reduction of time necessary for manufacturing.

In each of the light receiving unit and the image reader according to one embodiment of the technology, the couplers are provided at the respective positions, in the corresponding base members, based on the position at which the imaging performed by the optical system is performed, that is on opposite side to the light receiving devices. This makes it possible to avoid operation such as adjustment of a focal point of each of the light receiving heads that is to be performed after joining together the couplers with each other. As a result, the process of manufacturing is simplified, which is advantageous in reduction of time necessary for manufacturing.

In the method of manufacturing any of the first to third exposure units according to one embodiment of the technology, the first and second couplers are provided in advance at the positions, in the respective first and second base members, based on the position at which the imaging performed by the optical system is performed. This makes it possible to avoid operation such as adjustment of a focal position of each of the exposure heads that is to be performed after joining together the couplers with each other. As a result, the process of manufacturing is simplified, which is advantageous in reduction of time necessary for manufacturing.

According to the exposure head, the exposure unit, the method of manufacturing the exposure unit, the light receiving head, the light receiving unit, and the method of manufacturing the light receiving unit according to one embodiment of the technology, it is possible to achieve easier manufacturing.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An exposure unit comprising:

a first exposure head including a plurality of first light emitting devices, a first optical system, a first coupler, and a first base member, the first light emitting devices being disposed side by side in a first direction and each emitting a first light beam, the first optical system facing the first light emitting devices in a second direction that intersects with the first direction, and performing imaging of each of the first light beams emitted by the respective first light emitting devices, the first coupler being provided at a first position, in the first base member, based on a position at which the imaging performed by the first optical system is performed, the first base member supporting the first light emitting devices, the first optical system, and the first coupler; and a second exposure head including a plurality of second light emitting devices, a second optical system, a second coupler, and a second base member, the second light emitting devices being disposed side by side in the first direction and each emitting a second light beam, the second optical system facing the second light emitting devices in the second direction, and performing imaging of each of the second light beams emitted by the respective second light emitting devices, the second coupler being provided at a second position, in the second base member, based on a position at which the imaging performed by the second optical system is performed and being fit into the first coupler, the second base member supporting the second light emitting devices, the second optical system, and the second coupler.

2. The exposure unit according to claim 1, further comprising a third exposure head including a plurality of third light emitting devices, a third optical system, a third coupler, and a third base member, the third light emitting devices being disposed side by side in the first direction and each emitting a third light beam, the third optical system facing the third light emitting devices in the second direction, and performing imaging of each of the third light beams emitted by the respective third light emitting devices, the third coupler being provided at a third position, in the third base member, based on a position at which the imaging performed by the third optical system is performed, the third base member supporting the third light emitting devices, the third optical system, and the third coupler, wherein the second exposure head further includes a fourth coupler that is supported by the second base member, the fourth coupler being provided at a fourth position, in the second base member, based on the position at which the imaging performed by the second optical system is performed, and the third coupler and the fourth coupler are fit into each other.

3. The exposure unit according to claim 1, wherein the first coupler and the second coupler are respectively fixed to the first base member and the second base member by one of adhesion, welding, fusing, and screwing.

4. The exposure unit according to claim 1, wherein the first base member and the second base member have their respective shapes that are substantially same as each other, the first base member and the second base member have their respective dimensions that are substantially same as each other, and the first position relative to the first base member and the second position relative to the second base member are different from each other.

5. The exposure unit according to claim 1, wherein the first coupler is inserted into the second coupler in a third direction and is thereby fit into the second coupler, the third direction being different from both the first direction and the second direction.

6. An image forming unit, comprising the exposure unit according to claim 1.

7. An image forming apparatus, comprising the exposure unit according to claim 1.

8. An exposure unit comprising:

a first exposure head including a first substrate, a plurality of first light emitting devices, a first optical system, a first pedestal, a first coupler, and a first base member, the first light emitting devices being disposed side by side in a first direction on the first substrate and each emitting a first light beam, the first optical system facing the first light emitting devices in a second direction that intersects with the first direction, and performing imaging of each of the first light beams emitted by the respective first light emitting devices, the first pedestal being attached to the first substrate, the first coupler being provided at a first position, in the first pedestal, based on a position at which the imaging performed by the first optical system is performed, the first base member supporting the first substrate and the first optical system; and a second exposure head including a second substrate, a plurality of second light emitting devices, a second optical system, a second pedestal, a second coupler, and a second base member, the second light emitting devices being disposed side by side in the first direction on the second substrate and each emitting a second light beam, the second optical system facing the second light emitting devices in the second direction, and performing imaging of each of the second light beams emitted by the respective second light emitting devices, the second pedestal being attached to the second substrate, the second coupler being provided at a second position, in the second pedestal, based on a position at which the imaging performed by the second optical system is performed, and being fit into the first coupler, the second base member supporting the second substrate and the second optical system.

9. A light receiving unit comprising:

a first light receiving head including a plurality of first light receiving devices, a first optical system, a first coupler, and a first base member, the first light receiving devices being disposed side by side in a first direction, the first optical system facing the first light receiving devices in a second direction that intersects with the first direction, and performing imaging of, on the first light receiving devices, respective first light beams entering the first optical system from outside, the first coupler being provided at a first position, in the first base member, based on a position at which the imaging performed by the first optical system is performed, the first base member supporting the first light receiving devices, the first optical system, and the first coupler; and a second light receiving head including a plurality of second light receiving devices, a second optical system, a second coupler, and a second base member, the second light receiving devices being disposed side by side in the first direction, the second optical system facing the second light receiving devices in the second direction, and performing imaging of, on the second light receiving devices, respective second light beams entering the second optical system from the outside, the second coupler provided at a second position, in the second base member, based on a position at which the imaging performed by the second optical system is performed, and being fit into the first coupler, the second base member supporting the second light receiving devices, the second optical system, and the second coupler.

10. An image reader, comprising the light receiving unit according to claim 9.

11. A method of manufacturing an exposure unit, the method comprising:

preparing a first base member that supports a plurality of first light emitting devices and a first optical system, the first light emitting devices being disposed side by side in a first direction and each emitting a first light beam, the first optical system facing the first light emitting devices in a second direction that intersects with the first direction, and performing imaging of each of the first light beams emitted by the respective first light emitting devices;

providing a first coupler at a first position, in the first base member, based on a position at which the imaging performed by the first optical system is performed;

preparing a second base member that supports a plurality of second light emitting devices and a second optical system, the second light emitting devices being disposed side by side in the first direction and each emitting a second light beam, the second optical system facing the second light emitting devices in the second direction, and performing imaging of each of the second light beams emitted by the respective second light emitting devices;

providing a second coupler at a second position, in the second base member, based on a position at which the imaging performed by the second optical system is performed; and joining together the first base member and the second base member with each other by fitting the first coupler and the second coupler into each other.

12. The method according to claim 11, further comprising fixing the first coupler at the first position after the preparing of the first coupler.

13. A method of manufacturing an exposure unit, the method comprising:

preparing a first base member that supports a first substrate on which a plurality of first light emitting devices are provided and a first optical system, the first light emitting devices being disposed side by side in a first direction and each emitting a first light beam, the first optical system facing the first light emitting devices in a second direction that intersects with the first direction, and performing imaging of each of the first light beams emitted by the respective first light emitting devices;

attaching a first pedestal to the first substrate;

providing a first coupler at a first position, in the first pedestal, based on a position at which the imaging performed by the first optical system is performed;

preparing a second base member that supports a second substrate on which a plurality of second light emitting devices are provided and a second optical system, the second light emitting devices being disposed side by side in the first direction and each emitting a second light beam, the second optical system facing the second light emitting devices in the second direction, and performing imaging of each of the second light beams emitted by the respective second light emitting devices;

attaching a second pedestal to the second substrate;

providing a second coupler at a second position, in the second pedestal, based on a position at which the imaging performed by the second optical system is performed; and joining together the first substrate and the second substrate with each other by fitting the first coupler and the second coupler into each other.

14. A method of manufacturing a light receiving unit, the method comprising:

preparing a first base member that supports a plurality of first light receiving devices and a first optical system, the first light receiving devices being disposed side by side in a first direction, the first optical system facing the first light receiving devices in a second direction that intersects with the first direction, and performing imaging of, on the first light receiving devices, respective first light beams entering the first optical system from outside;

providing a first coupler at a first position, in the first base member, based on a position at which the imaging performed by the first optical system is performed;

preparing a second base member that supports a plurality of second light receiving devices and a second optical system, the second light receiving devices being disposed side by side in the first direction, the second optical system facing the second light receiving devices in the second direction, and performing imaging of, on the second light receiving devices, respective second light beams entering the second optical system from the outside;

providing a second coupler at a second position, in the second base member, based on a position at which the imaging performed by the second optical system is performed; and joining together the first base member and the second base member with each other by fitting the first coupler and the second coupler into each other.

* * * * *